US009397404B1

(12) United States Patent
McDevitt et al.

(10) Patent No.: US 9,397,404 B1
(45) Date of Patent: Jul. 19, 2016

(54) CROSSED-DIPOLE ANTENNA ARRAY STRUCTURE

(71) Applicant: FIRST RF Corporation, Boulder, CO (US)

(72) Inventors: Sean P. McDevitt, Thornton, CO (US); Ian S. Rumsey, Thornton, CO (US); Joseph Mruk, Boulder, CO (US); P. Keith Kelly, Berthoud, CO (US)

(73) Assignee: FIRST RF Corporation, Boulder, CO (US)

( * ) Notice: Subject to any disclaimer, the term of this patent is extended or adjusted under 35 U.S.C. 154(b) by 164 days.

(21) Appl. No.: 14/268,626

(22) Filed: May 2, 2014

(51) Int. Cl.
*H01Q 21/26* (2006.01)
*H01Q 9/16* (2006.01)

(52) U.S. Cl.
CPC ..... *H01Q 9/16* (2013.01)

(58) Field of Classification Search
CPC ..... H01Q 5/48; H01Q 9/285; H01Q 19/108; H01Q 21/062
USPC ..... 343/793, 795, 797
See application file for complete search history.

(56) References Cited

U.S. PATENT DOCUMENTS

| | | | | |
|---|---|---|---|---|
| 4,287,518 | A | 9/1981 | Ellis, Jr. | |
| 4,686,536 | A | 8/1987 | Allcock | |
| 4,825,220 | A | 4/1989 | Edward et al. | |
| 5,966,102 | A | 10/1999 | Runyon | |
| 6,034,649 | A * | 3/2000 | Wilson | H01Q 1/246 343/795 |
| 6,067,053 | A | 5/2000 | Runyon et al. | |
| 6,069,590 | A | 5/2000 | Thompson, Jr. et al. | |
| 6,072,439 | A | 6/2000 | Ippolito et al. | |
| 6,329,954 | B1 | 12/2001 | Fuchs et al. | |
| 6,515,633 | B2 | 2/2003 | Ippolito | |
| 6,621,465 | B2 * | 9/2003 | Teillet | H01Q 1/246 343/797 |
| 7,053,852 | B2 | 5/2006 | Timofeev et al. | |
| 7,616,168 | B2 | 11/2009 | Tillery | |
| 7,940,227 | B2 | 5/2011 | Chou | |
| 8,242,966 | B2 | 8/2012 | Liu | |
| 8,269,686 | B2 | 9/2012 | Johnston et al. | |
| 8,648,759 | B2 * | 2/2014 | Wang | H01Q 1/286 343/700 MS |
| 2006/0273865 | A1 | 12/2006 | Timofeev et al. | |

OTHER PUBLICATIONS

Lee et al., A Low-Profile Wide-Band (5:1) Dual-Pol Array, IEEE Antennas and Wireless Propagation Letters, 2003, pp. 46-49, vol. 2.

(Continued)

*Primary Examiner* — Dameon E Levi
*Assistant Examiner* — Hasan Islam
(74) *Attorney, Agent, or Firm* — Christopher J. Kulish

(57) ABSTRACT

The invention is directed to a crossed-dipole antenna structure that, in one embodiment, is comprised of: (a) a first planar dielectric substrate with a feed portion and an antenna portion that supports a first dipole antenna and (b) a second planar dielectric substrate that supports a second dipole antenna or substantial portion of such an antenna. The first and second planar dielectric substrates are positioned substantially perpendicular to one another and so as to form a crossed-dipole antenna from the first and second dipole antennas. The feed portion of the first planar dielectric substrate is electrically and mechanically connected to the second planar substrate by a plurality of solder joints established in the corners defined by the intersections of the first and second planar dielectric substrates.

29 Claims, 27 Drawing Sheets

(56) References Cited

OTHER PUBLICATIONS

Cavallo et al., Analysis of Common-Mode Resonances in Arrays of Connected Dipoles and Possible Solutions, Proceedings of the 6th European Radar Conference, 2009, pp. 441-444.

Stasiowski et al., Broadband Array Antenna, May 7, 2011, pp. 1-18.

Parfitt et al., The Single Wire Fed Dipole on Slab: An Antenna for Integration with Monolithic Microwave and Millimetre Wave Circuits, Antennas and Propagation Society International Symposium, 1990, pp. 795-798, vol. 2.

* cited by examiner

CROSSED-DIPOLE ANTENNA ARRAY STRUCTURE

FIELD OF THE INVENTION

The invention relates to a crossed dipole antenna array structure in which one planar dielectric substrate supports one dipole of a crossed dipole and a second planar dielectric substrate supports the other dipole of the crossed-dipole and the feed circuitry/electronics for both of the dipoles.

BACKGROUND OF THE INVENTION

Generally, a crossed-dipole antenna includes a first dipole with a first pair of radiating elements that are in some fashion oriented in or about a first plane and a second dipole with a second pair of radiating elements that are oriented in or about a second plane that is substantially perpendicular to the first plane. The radiating elements can be any of a number of different types (e.g., wires, triangles, spades etc.). Typically, all of the radiating elements in a crossed-dipole are of the same type.

In one type of crossed-dipole antenna, a first dipole is established on a first planar dielectric substrate and a second dipole is established on a second dielectric substrate. The first and second dipoles are typically established on their respective substrates by well-known printing and/or etching techniques. In many cases, the first and second planar dielectric substrates are disposed perpendicular to one another and perpendicular to a mounting/feed substrate. The mounting/feed substrate provides a first set of connection points for electrically connecting one of the dipoles to feed circuitry that is connected to or established on the mounting/feed substrate and a second set of connection points for electrically connecting the other dipole to feed circuitry that is also connected to or established on the mounting/feed substrate.

In many instances, the mechanical connection between the first and second substrates with their respective dipoles is established using an "egg crate" technique in which an "upwardly" extending slot associated with the first substrate receives a portion of the second substrate and "downwardly" extending slot associated with the second substrate receives a portion of the first substrate. An example, of this technique is disclosed in U.S. Pat. No. 4,686,536.

While the "egg crate" technique mechanically connects the two substrates, the connection typically allows the substrates to rotate relative to one another such that the first and second substrates and their dipoles are not substantially perpendicular to one another. To establish the needed perpendicular relationship, two techniques are frequently employed. The first technique connects a brace to each of the substrates to establish the needed perpendicularity. In the second technique, a mounting/feed substrate defines holes/slots that each receive a portion of each the first and second substrates in a manner that establishes the requisite perpendicularity between the substrates. Arrays of crossed-dipole antennas in which the dipole antennas have been established on planar dielectric substrates and the needed perpendicularity established with braces and/or mounting slots have also been created.

SUMMARY OF THE INVENTION

The invention is directed to a crossed-dipole antenna array structure that includes a dipole card with multiple dipole antennas and the feed circuitry for the multiple dipole antennas associated with the card, as well as the feed circuitry for each of the dipoles that cooperate with one of the dipole antennas on the dipole card to form a crossed-dipole antenna. The structure further includes multiple crossing dipole cards, each of which includes a portion of a crossing dipole antenna. Each of crossing dipole cards is disposed substantially perpendicular to the dipole antenna card (i.e., in the range of 90°±10°) and such that the portion of the crossing dipole antenna on the crossing dipole card and one of the dipole antennas on the dipole card form a crossed-dipole antenna. Collectively, the dipoles on the dipole card and the portions of dipoles on the multiple crossing dipole cards are combined to establish an array of crossed-dipole antennas. Also included in the structure is a reflector surface that is positioned perpendicular to the dipole card and such that the crossed-dipole antennas are located to one side of the reflector surface and the feed circuitry is located on the other side of the reflector surface. A frame supports the dipole card, the crossing dipole cards, and the reflector surface.

In one embodiment of the structure, each of the crossing dipole cards engages the dipole card such that four corners are defined between the crossing dipole card and the dipole card. These four corners are significant as to the both the physical and electrical interconnection of the cards. To elaborate, the dipole antenna and the portion of a crossing dipole antenna that are combined to form a crossed-dipole antenna respectively are established on the dipole card and the crossing dipole card such that the electrical connections needed to electrically complete the crossing dipole antenna and to establish an electrical connection between the crossing dipole antenna and the feed circuitry located on the dipole card are established by a plurality of solder joints with each solder joint located in one of the corners defined by the dipole card and crossing dipole card. In a particular embodiment, only three such solder joints are needed to establish the necessary electrical connections for operation of the crossing dipole antenna. Each of the solder joints, in addition to establishing an electrical connection, also serves to mechanically establish a brace between the surfaces of the dipole and crossing dipole cards that define the corner in which the solder joint is located. As such, each of the solder joints operates to maintain a substantially perpendicular relationship between the dipole and crossing dipole respectively associated with the dipole card and the relevant crossing dipole card that form one of the crossed-dipoles.

Another embodiment of the structure particularly addresses a problem that becomes more prevalent as the operating frequency at which the crossed-dipoles operate increases. To elaborate, as the operating frequency increases, the size of the crossed-dipoles and related structures decreases. Moreover, in an array of crossed-dipoles, the spacing between the crossed-dipoles decreases as the operating frequency range increases. For example, in a crossed-dipole antenna designed to operate in the Ku band (14-16 GHz for data links), the distances between the ends of the radiating elements of one dipole of a crossed-dipole and between immediately adjacent crossed-dipoles are typically on the order of 9-10 mm. With such small structures and distances between adjacent crossed-dipole antennas, establishing a crossing dipole card substantially perpendicular to a dipole card using a conventional "cross brace" with ends that are attached to the two cards and that extends diagonally between the cards becomes increasing problematic. In this embodiment, the cross-dipole antenna array structure employs a dipole card and crossing dipole cards that supplement notches which allow an "egg crating" engagement between the cards with at least two rails that are disposed parallel to each intersection line defined by the engagement of dipole card and one of the crossing dipole cards. Each of the rails is associated with one of the dipole card and the crossing dipole card, extends away from the surface of the card, and engages a surface associated with the other card in a manner that promotes perpendicularity between the dipole card and the crossing dipole card. In a particular embodiment, four rails are disposed parallel to each intersection line defined by the engagement of the dipole card and one of the crossing dipole cards. Each of the rails is located in a separate corner. By having a rail in each corner, a high degree of perpendicularity can be established between the dipole card and each of the crossing dipole cards. In one embodiment, each of the rails is also electrically conductive and a portion of one of the dipole antenna and crossing dipole antenna that form a crossed-dipole. Consequently, the rails serve both to facilitate perpendicularity between the dipole card and the crossing dipole card and to function as part of a crossed-dipole antenna. In yet a further embodiment, each of the rails is electrically conductive, a portion of one of the dipole antenna and crossing dipole antenna that form a crossed-dipole antenna, and provides a solder surface for establishing one of the multiple solder joints. As such, the rails serve to facilitate perpendicularity between the cards, function as part of a crossed-dipole antenna, provide solder surfaces that, if used, substantially fix the perpendicularity established by the interaction of the rails and the card surfaces, and establish electrical connections between the crossing dipole and the feed circuitry located on the dipole card.

Yet another embodiment that addresses the problem of establishing substantial perpendicularity between the crossing dipole cards and the dipole card supplements notches which allow an "egg crating" engagement between the cards with a tab-and-hole structure. In a particular embodiment, a plurality of holes are defined by the dipole card with each hole located along one of the intersection lines defined by the engagement of the dipole card and each one of the crossing dipole cards. The crossing dipole card has an edge that defines a tab located to engage one of the holes and, in so doing, establish a substantially perpendicular relationship between the crossing dipole card and the dipole card. The solder joints subsequently established further solidify the perpendicular arrangement. It should be appreciated that a structure in which a crossing dipole card defines a hole that is occupied by a tab defined by the edge of the dipole card is also feasible in many instances. The use of the tab-and-hole structure in combination with the "egg crating" structure to establish perpendicularity between the cards is typically more useful in crossed-dipole arrays that operating at lower frequencies (i.e., below the Ku band) where the dimensions of the crossed-dipoles and the distances between adjacent crossed-dipole are greater. Nonetheless, the tab-and-hole structure can also be used in combination with a rail structure to establish the needed perpendicularity between the cards.

Another embodiment of the crossed-dipole antenna array structure includes a heat sink for dissipating heat produced by the power amplifier/amplifiers that is/are associated with each crossed-dipole antenna in the array. The feed circuitry for the crossed-dipole antennas is laid out on the dipole card so as to lie to one side of the reflector surface, the dipole antennas being established on the other side of the reflector surface. The power amplifier(s) that are part of the feed circuitry for each of the dipole and crossing dipole antennas is/are established on one side of the dipole card, on the portion of the dipole card that is located to the one side of the reflector surface that is associated with the feed circuitry, and on the portion of the dipole card that is relatively close to the location of the reflector surface. The heat sink includes a pair of planar surfaces that are perpendicular to one another. One of these planar surfaces is connected to the other side of the dipole card (i.e., the side of the dipole card that does not support the power amplifier(s) for a crossed-dipole or multiple crossed-dipoles) and substantially opposite to the locations of the power amplifiers so as to establish a thermal circuit between the power amplifiers and the heat sink. The other planar surface of the heat sink is thermally connected to the reflector to allow heat produced by the power amplifiers to be transmitted by the heat sink to the reflector and then dissipated by the reflector. In a particular embodiment, the reflector is comprised of multiple pieces that are both perpendicular to the dipole card and sandwich the dipole card such that the crossed-dipole antennas are located to one side of the reflector and the feed circuitry (including the power amplifiers) is located to the other side of the reflector. In this embodiment, the other planar surface of the heat sink is thermally connected to one of the two pieces of the reflector. This provides a modular structure comprised of the dipole card with the plurality of crossing dipole cards, a heat sink, and a portion of the reflector that can be readily inserted to and removed from the frame.

DETAILED DESCRIPTION

Figure 1:
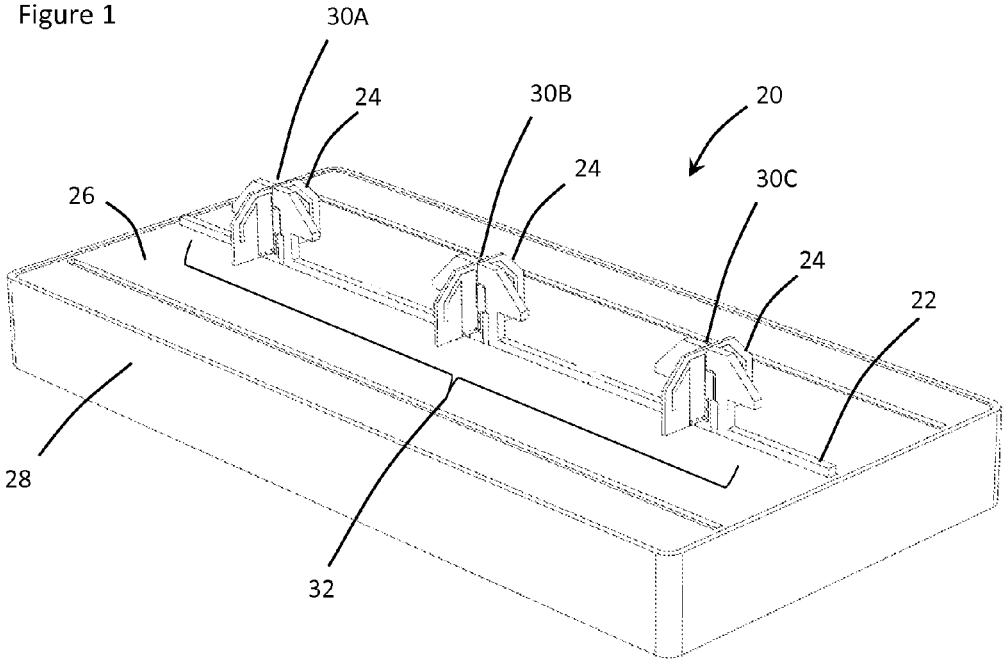
FIG. 1 illustrates an embodiment of a crossed-dipole antenna array structure comprised of a dipole card, a plurality of crossing dipole cards operatively attached to the dipole card, a reflector, and a frame for supporting the dipole card and the reflector.
Figure 2:
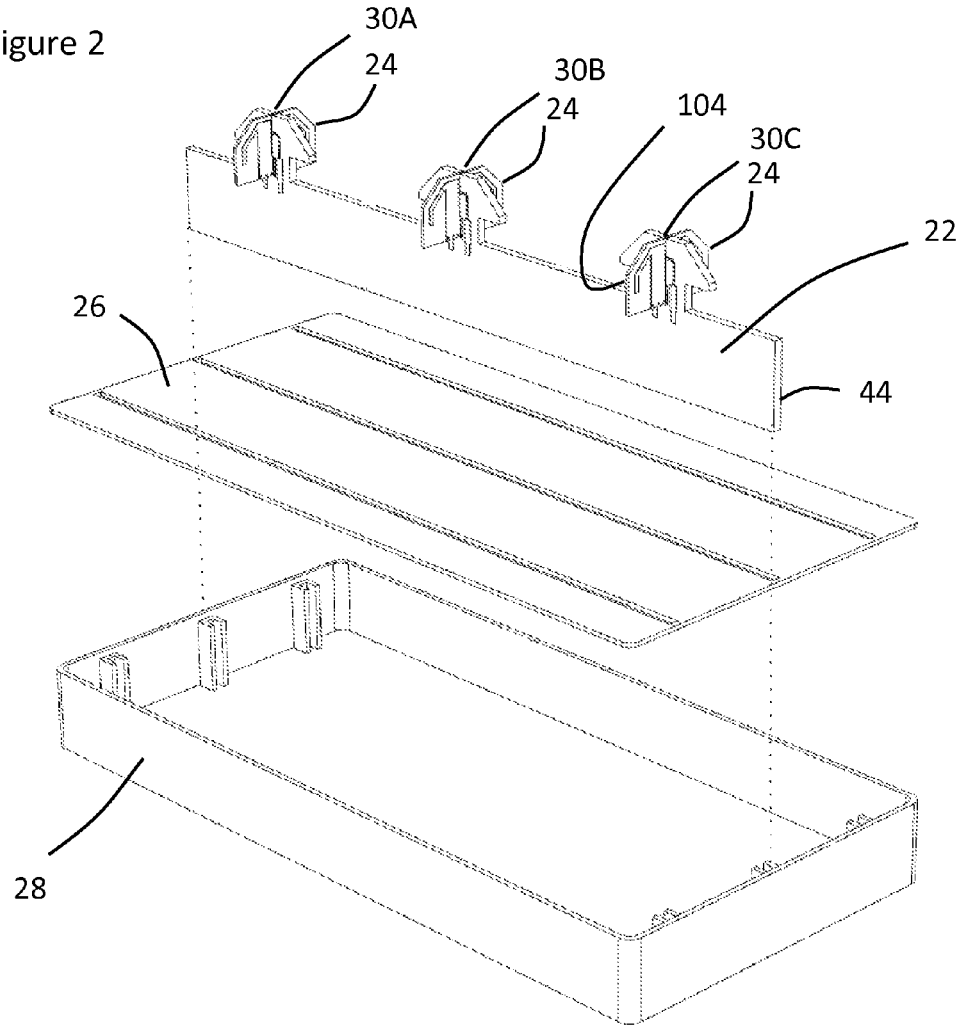
FIG. 2 is an exploded view of the crossed-dipole antenna array structure shown in FIG. 1.

With reference to FIGS. 1 and 2, an embodiment of a crossed-dipole antenna array structure 20 (hereinafter structure 20) is described. Generally, the structure 20 is comprised of a dipole card 22, a plurality of crossing dipole cards 24, a reflector 26, and a frame 28.

The dipole card 22 supports a plurality of dipole antennas. Each of the crossing dipole cards 24 supports a substantial portion of a crossing dipole antenna. Additionally, each of the crossing dipole antenna cards 24 is disposed substantially perpendicular to the dipole card 22 and, when operatively associated with the dipole card 22, establishes one of a plurality of crossed-dipole antennas 30A-30C formed from one of the dipole antennas on the dipole card 22 and the substantial portion of the crossing dipole antenna associated with the crossing dipole card 24. The operative association of all of the crossing dipole cards 24 with the dipole card 22 produces an array of crossed-dipole antennas 32. The reflector 26 serves to restrict the radiation produced by or received by the array of crossed-dipole antennas 32 to a single hemisphere (i.e., the hemisphere located on same side of the reflector 26 as the array 32) and is located such that the array of crossed-dipole antennas 32 is located on one side of the reflector and a substantial portion of the dipole card 22 is located on the other side of the reflector. This substantial portion of the dipole card 22 supports circuitry and/or electronic devices that are used in processing a signal provided to or received from each of the crossed dipole antennas in the array 32. The frame 28 generally serves to support the dipole card 22 and the crossing dipole cards operatively associated with the dipole card in a preferred orientation and, more typically, to support a plurality of dipole cards and related crossing dipole cards in preferred orientations to one another. In this regard, the frame 28 is capable of supporting a plurality of dipole cards such that the cards are disposed substantially parallel to one another and so that the arrays of crossed-dipole antennas associated with the plurality of dipole cards lie in a plane. The frame 28 also serves to support the reflector 26 such that the reflective surface of the reflector 26 is substantially perpendicular to the dipole card(s) supported by the frame.

Figure 3A:
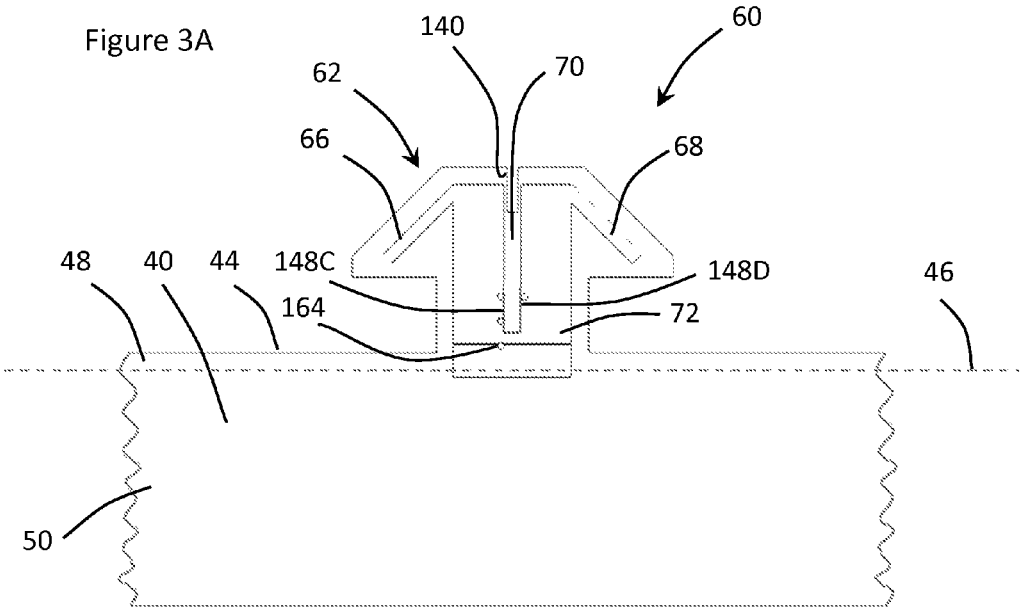
FIGS. 3A-3B respectively are plan views of one side of a portion of the dipole card and the other side of the portion of the dipole card.
Figure 3B:
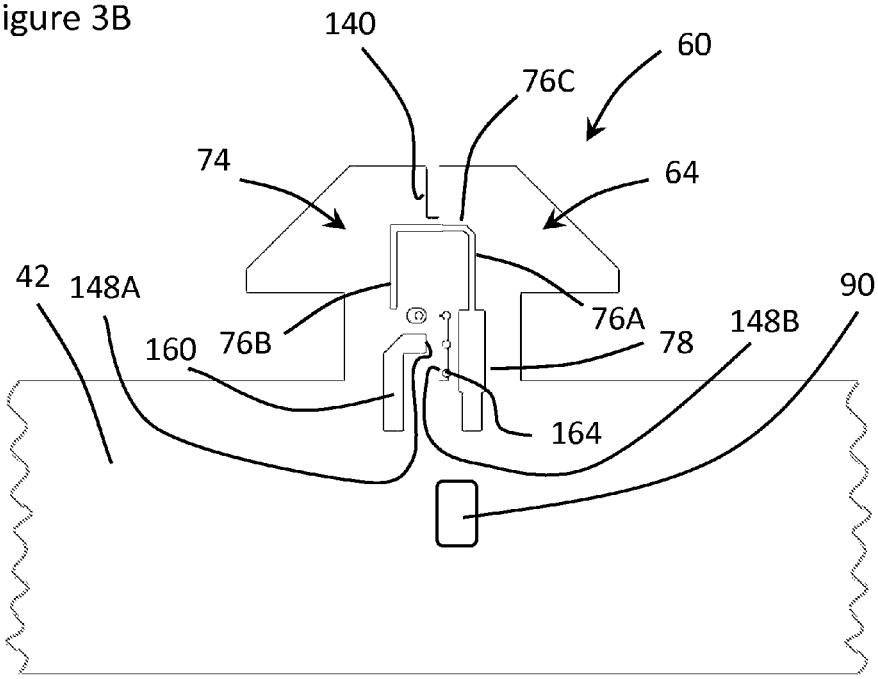

With reference to FIGS. 3A-3B and continuing references to FIGS. 1-2, the dipole card 22 is comprised of a planar dielectric substrate with patterned metallizations established on the surface of the substrate by techniques well known in the art, such as etching and deposition, to realize the dipole antennas and other circuit paths. The patterned metallizations typically extend only a few microns (typically, ≤35 μm) above the surface of the substrate. As such, the dipole card 22 is a substantially planar structure. It should also be appreciated that in various embodiments the planar dielectric substrate is entirely composed of a dielectric material; in other embodiments, the planar dielectric substrate is comprised of dielectric layers interposed with other layers that provide circuit pathways; and in yet other embodiments, the planar dielectric has structures known as via holes that provide pathways for conveying electrical signals between the various surfaces and/or layers of the substrate.

The dipole card 22 has a first dipole card surface 40, a second dipole card surface 42 that is substantially parallel to the first dipole card surface 40, and a dipole card edge 44 that extends between the surfaces 40, 42. A reflector line 46 defines the location of the upper surface of the reflector 26 in the assembled structure 20. Additionally, the reflector line 46 divides the dipole card 22 into an antenna portion 48 and a feed circuitry portion 50.

The antenna portion 48 supports the plurality of dipole antennas associated with the card 22. In this regard, one of the plurality of dipole antennas 60 is comprised of a dipole radiator 62 and an antenna feed structure 64. The dipole radiator 62 includes a first radiator arm 66 and a second radiator arm 68 that is separated from the first radiator arm 66 by a gap 70. The dipole radiator 62 is an electrically conductive metallization disposed on the first dipole card surface 40. The antenna feed structure 64 is a J-balun that converts a signal between a balanced and unbalanced signal as is well known in the art. The antenna feed structure 64 includes a generally U-shaped balun ground plane 72 located on the first dipole card surface 40 and a U-shaped conductor 74 that is disposed on the second dipole card surface 42 and opposite the ground plane 72. The U-shaped conductor 74 is comprised of a transmission line portion 76A, a shorting stub portion 76B (also known as a λ/4 open circuit stub), and a conductor 76C that connects the transmission line portion 76A and shorting stub portion 76B and spans the gap 70. As an alternative to the shorting stub portion 76B, a direct short can be employed. The transmission line portion 76A is operatively connected to a second transmission line 78 that is not part of the balun but does connect the balun to the circuitry and/or electronics associated with feed circuitry portion 50 of the first dipole card surface 40. The balun ground plane 72 is an electrically conductive metallization disposed on the first dipole card surface 40. Each of the U-shaped conductor 74 and second transmission line 78 is an electrically conductive metallization disposed on the second dipole card surface 42.

The feed circuitry portion 50 supports circuitry and/or electronics associated with processing an electrical signal to be provided to or received from each crossed-dipole antenna 30 realized by the operative association of the dipole card 22 and the crossing dipole cards 24. In this regard, at least one power amplifier 90 is associated with each crossed-dipole antenna and each such power amplifier is preferably located relatively close to the reflector line 46 and in line with the crossed-dipole antenna to reduce transmission losses between the amplifier and the crossed-dipole antenna.

Depending on the manner in which the array of crossed-dipole antennas is to be used, a second power amplifier may also be associated with one of more of the crossed-dipole antennas 30. Each such additional power amplifier is also preferably located relatively close to the reflector line 46. The feed circuitry portion 50 may also support many other types of circuit elements that are used in conjunction with the array of crossed-dipole antennas 32, including power dividers, phase shifters, attenuators, and support circuitry, such as controllers and power conditioners. Further, a portion of one or both of the first and second dipole card surfaces 40, 42 adjacent to the dipole card edge 44 is configured for, or supports a connector capable of, engaging a mating connector associated with a mother board or similar structure to convey electrical signal between the dipole card 22 and other electronics associated with the operation of the antenna.

Figure 4A:
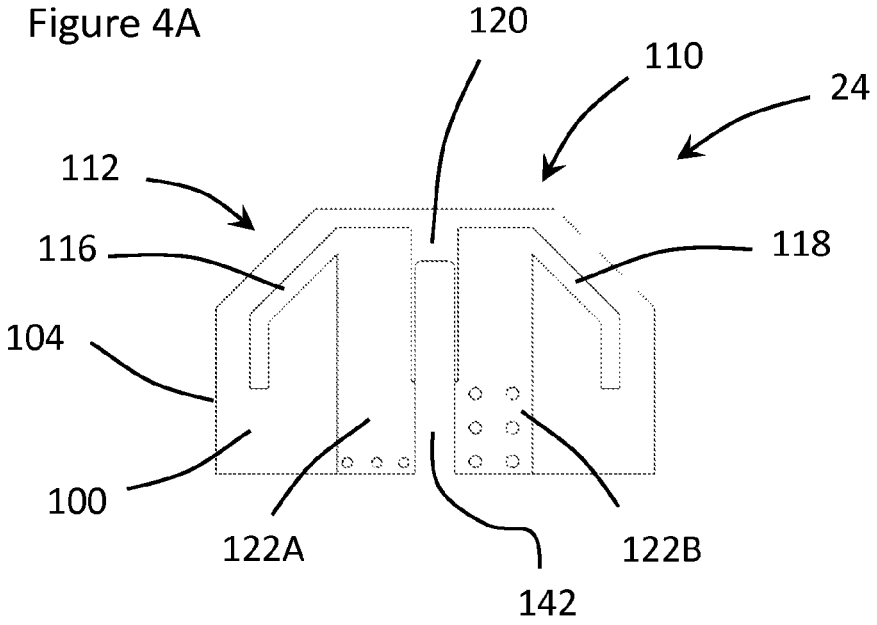
FIGS. 4A-4B respectively are plan views of one side of one of the crossing dipole cards and the other side of the crossing dipole card.
Figure 4B:
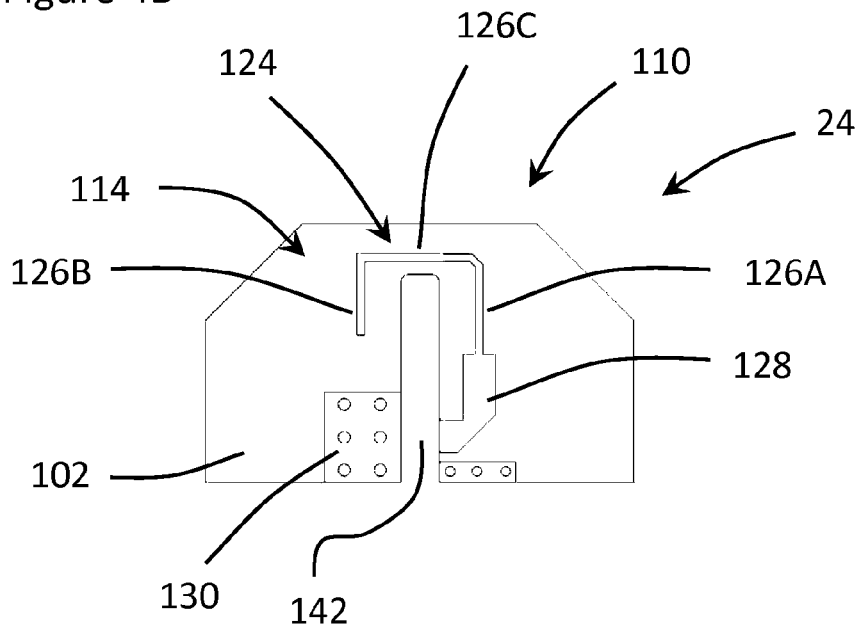
Figure 5A:
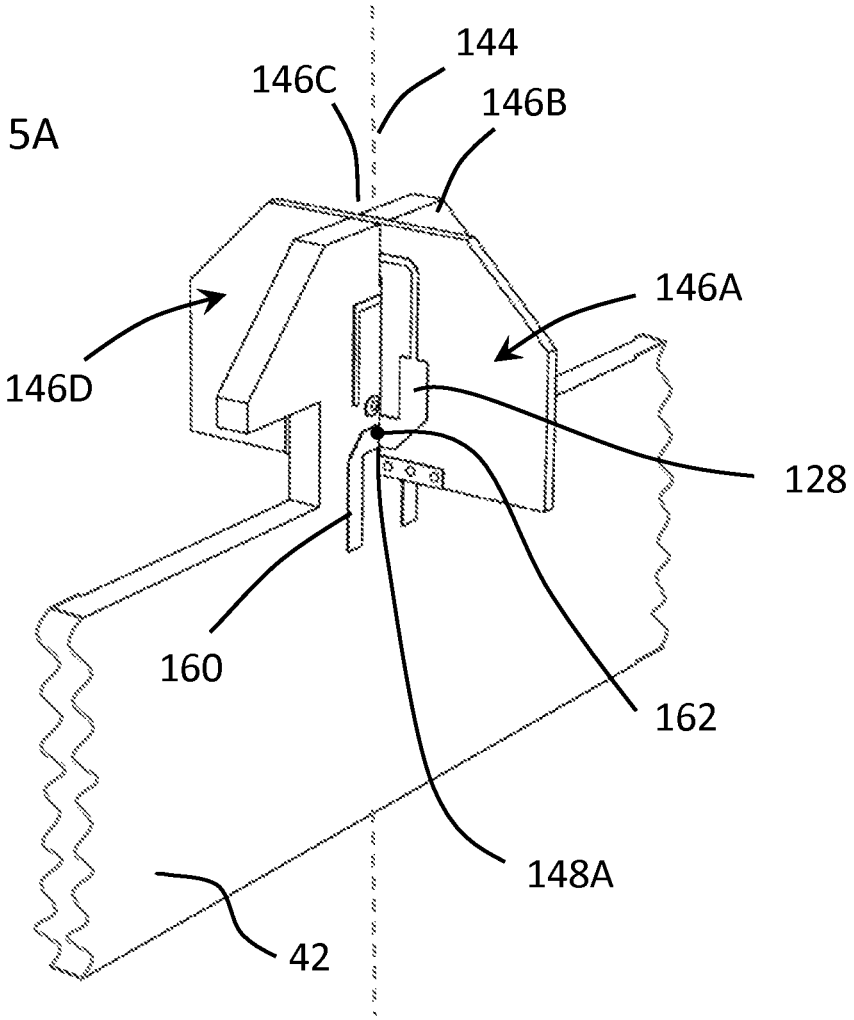
FIG. 5A-5D are perspective views on each of the four corners of the crossed-dipole antenna formed by the dipole card and one of the crossing dipole cards.
Figure 5B:
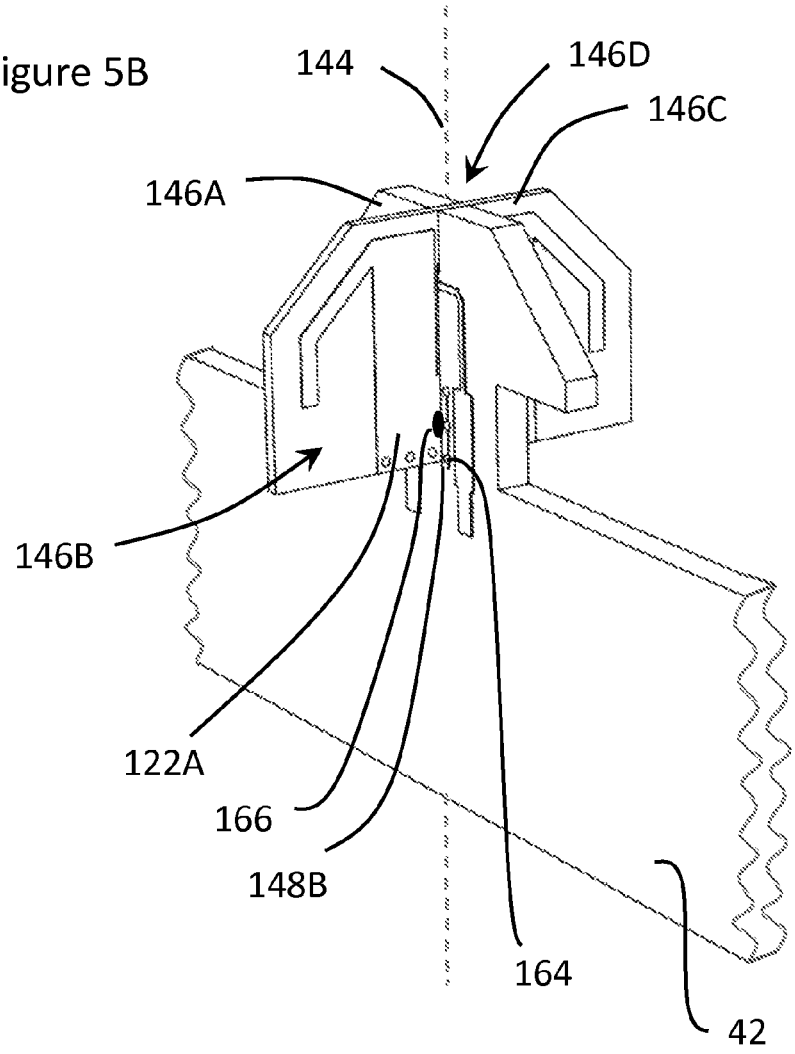
Figure 5C:
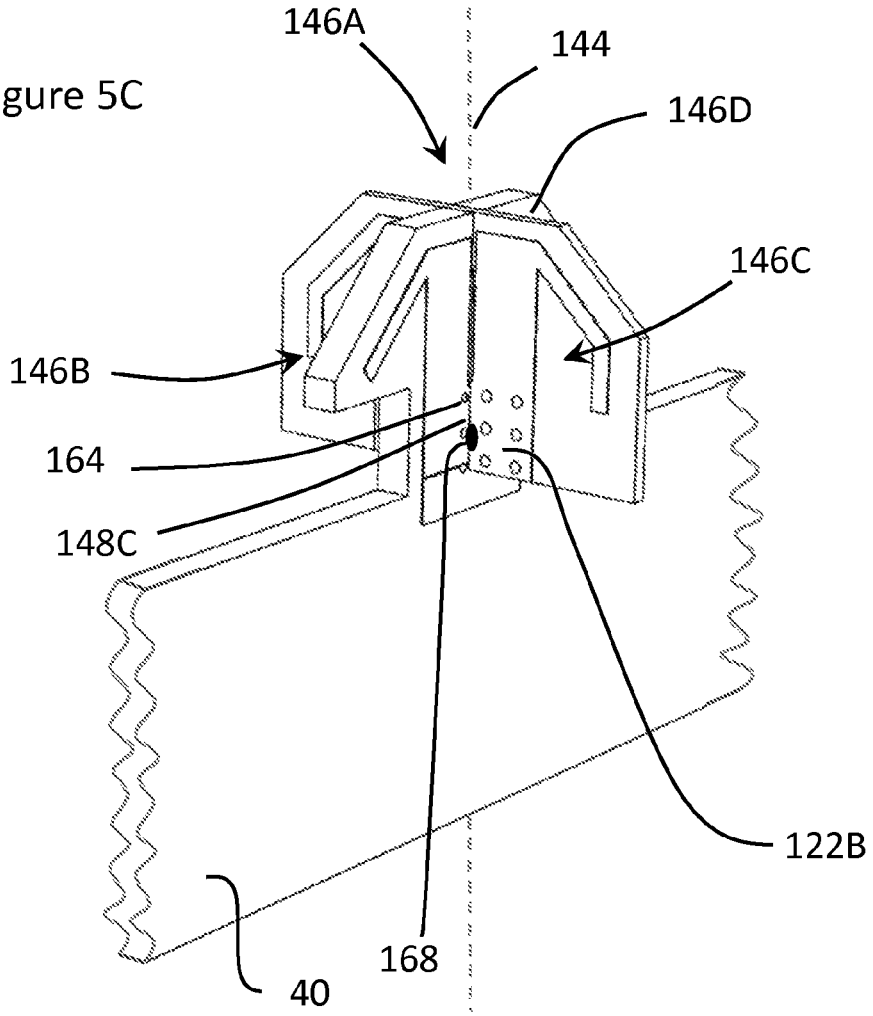
Figure 5D:
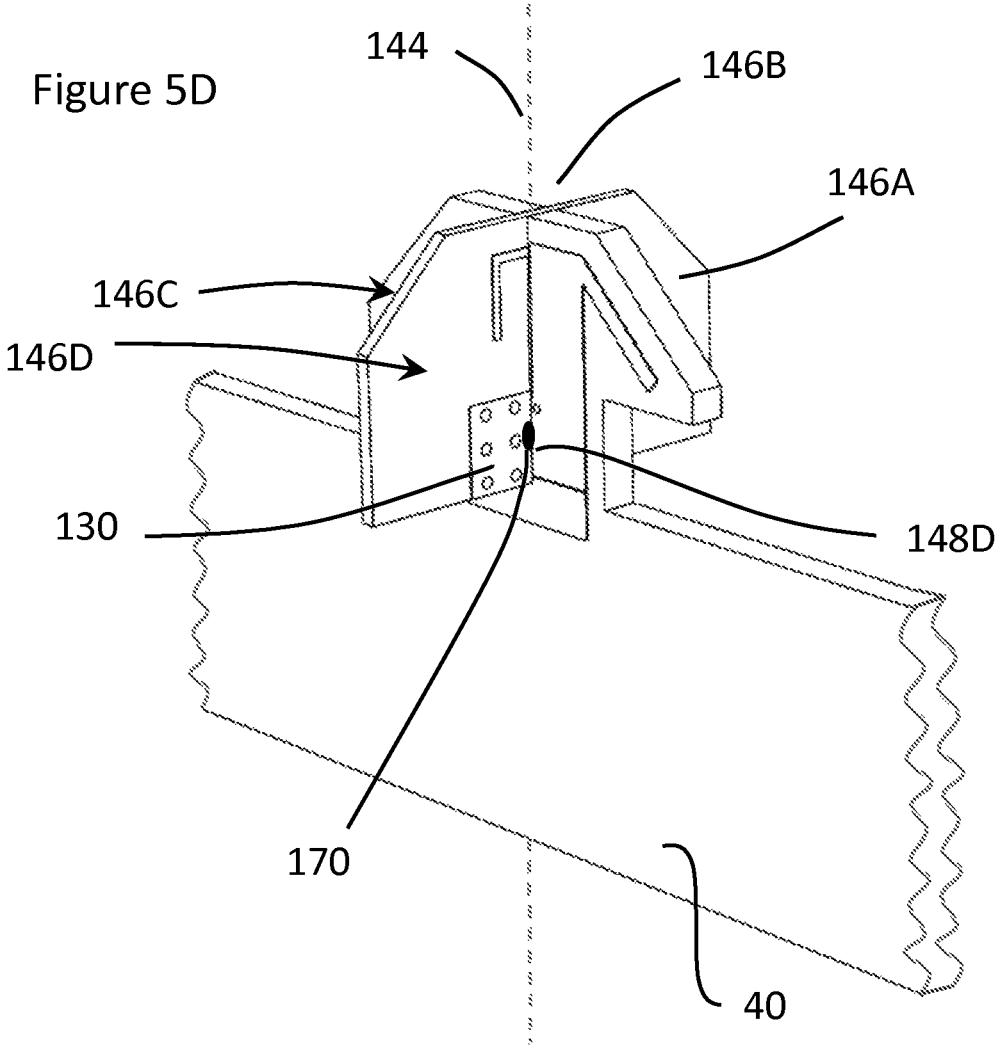

With reference to FIGS. 4A-4B and continuing references to FIGS. 1-2, one of the crossing dipole cards 24 is comprised of a planar dielectric substrate with patterned metallizations established on the surface of the substrate by techniques well known in the art, such as etching and deposition, to realize a substantial portion of the crossing dipole antenna and other circuitry. The patterned metallizations typically extend only a few microns above the surface of the substrate. As such, the dipole card 22 is a substantially planar structure. It should also be appreciated that in various embodiments the planar dielectric substrate is entirely composed of a dielectric material; in other embodiments, the planar dielectric substrate is comprised of dielectric layers interposed with other layers that provide circuit pathways; and in yet other embodiments, the planar dielectric has structures known as via holes that provide pathways for conveying electrical signals between the various surfaces and/or layers of the substrate.

Each one of the crossing dipole cards 24 has a first crossing dipole card surface 100, a second crossing dipole card surface 102 that is substantially parallel to the first crossing dipole card surface 100, and a crossing dipole card edge 104 that extends between the surfaces 100, 102.

The portion of a crossing dipole antenna 110 associated with one of the crossing dipole cards 24 is comprised of a dipole radiator 112 and a feed structure 114. The dipole radiator 112 includes a first radiator arm 116 and a second radiator arm 118 that is separated from the first radiator arm 116 by a gap 120. The feed structure 114 is a portion of a J-balun that converts a signal between a balanced and unbalanced signal, as is well known in the art. The feed structure 114 includes a pair of lands 122A, 122B that are located on the first crossing dipole card surface 100 and a U-shaped conductor 124 that is disposed on the second crossing dipole card surface 102 and opposite the lands 122A, 122B. The pair of lands 122A, 122B form the upright legs of a generally U-shaped balun ground plane. A base portion of the U-shaped balun ground plane is established by the operative connection established between a crossing dipole card 24 and the dipole card 22. The U-shaped conductor 124 is comprised of a transmission line portion 126A, a shorting stub portion 126B, and a conductor 126C that connects the transmission line portion 126A and shorting stub portion 126B and spans the gap 120. The transmission line portion 126A is operatively connected a second transmission line 128 that is not part of the balun but is used to establish a connection between the balun and circuitry and/or electronics associated with feed circuitry portion 50 of the dipole card 22. A land 130 is also established on the second crossing dipole card surface 102 to facilitate establishing perpendicularity between the crossing dipole card 24 and the dipole card 22. Each of the pair of lands 122A, 122*b* is an electrically conductive metallization disposed on the first crossing dipole card surface 100. Each of the U-shaped conductor 124 and second transmission line 128 is an electrically conductive metallization disposed on the second crossing dipole card surface 102.

With reference to FIGS. 5A-5D and continuing reference to FIGS. 3A-3B and 4A-4B, the operative connection between the dipole card 22 and one of the crossing dipole cards 24 is described. Generally, the edge 44 of the dipole card 22 and the edge 104 of the crossing dipole card 24 respectively define notches 140, 142 that allow the dipole card 22 and the crossing dipole card 24 to engage one another in an "egg crate" fashion that, without more, establishes a rough and relatively unstable perpendicularity between the cards. When the cards are engaged in this manner and substantially perpendicular to one another, the engagement defines an intersection volume (a rectangular prism that is characterized as an intersection line 144), and corners 146A-146D.

Figure 6:
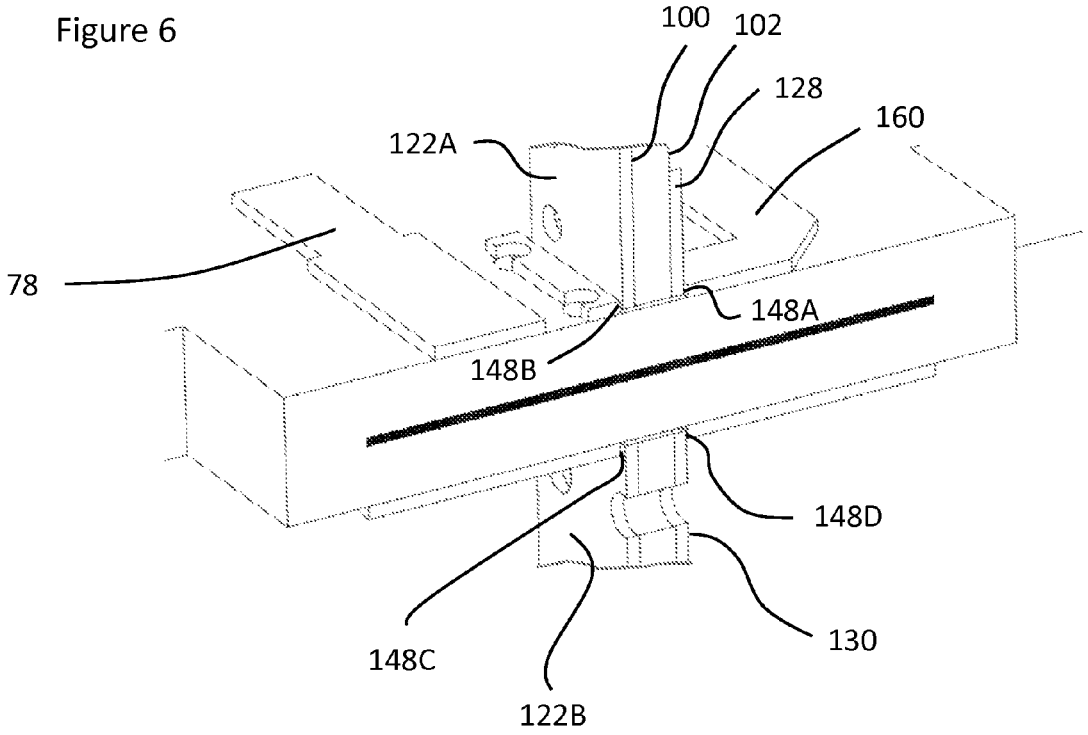
FIG. 6 is a cross-sectional view of one of the crossed-dipole antennas of the array structure shown in FIG. 1 illustrating rails that serve, among other things, to establish perpendicularity between the dipole card and one of the crossing dipole cards that are used to form one of the crossed-dipole antennas.

To establish a more stable perpendicularity between the cards, four parallel rails are established with one of the parallel rails in each of the four corners 146A-146D. Each of the rails is established on one of the surfaces of one of the dipole card 22 and the crossing dipole card 24 and extends above the surface of the card. Further, the distance between pairs of rails that are located in adjacent corners is established to be only slightly greater that the distance between whatever card related surfaces are to be interposed between the pair of rails. In the illustrated embodiment, the dipole card 24 has four parallel rails 148A-148D. With reference to FIG. 6, the rails 148A, 148B respectively engage the second transmission line 128 and the land 122A of the crossing dipole card 24. The distance between the rails 148A, 148B is only slightly greater that the distance that is the sum of the distance between the first and second crossing dipole surfaces 100, 102, the thickness of the second transmission line 128, and the thickness of the land 122A. As such, the rails 148A, 148B tend to channel the crossing dipole card 24 into a perpendicular relationship with the dipole card 22. The rails 148C, 148D respectively engage the land 122B and the land 130 of the crossing dipole card 24. The distance between the rails 148C, 148C is only slightly greater that the distance that is the sum of the distance between the first and second crossing dipole surfaces 100, 102, the thickness of the land 122B, and the thickness of the land 130. As such, the rails 148C, 148D tend to channel the crossing dipole card 24 into a perpendicular relationship with the dipole card 22.

It should be appreciated that a single rail may be useful in establishing a sufficiently stable perpendicularity between the dipole card 22 and the crossing dipole card 24. For example, a single rail may be useful in establishing sufficiently stable perpendicularity between the cards during the manufacture of the structure 20 while a yet more stable and/or more permanent structure is put in place to create a more permanent perpendicularity. Generally, the greater the number of rails that each reside in a separate corner, the more useful the rails are in in establishing a more stable perpendicularity between the cards. Hence, the illustrated embodiment employs the four rails 148A-148D. It should also be appreciated that, when multiple rails are employed, all of the rails do not necessarily need to be located on the dipole card or the same one of the dipole card and crossing dipole card. The rails can be distributed between the dipole card and the crossing dipole card.

Figure 7:
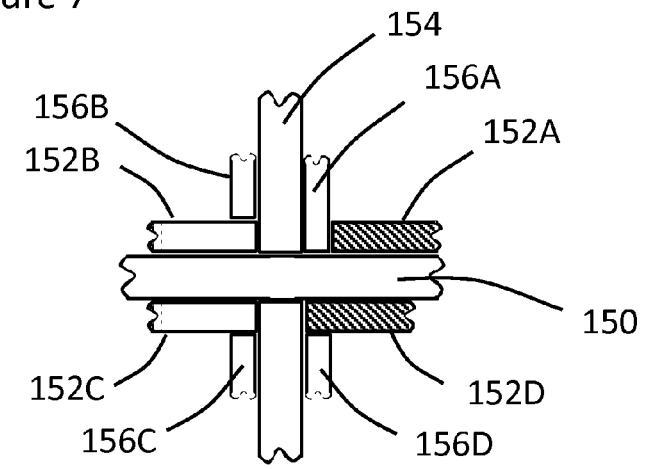
FIG. 7 illustrates alternative rail structures to the rail structure shown in FIG. 6.
Figure 8A:
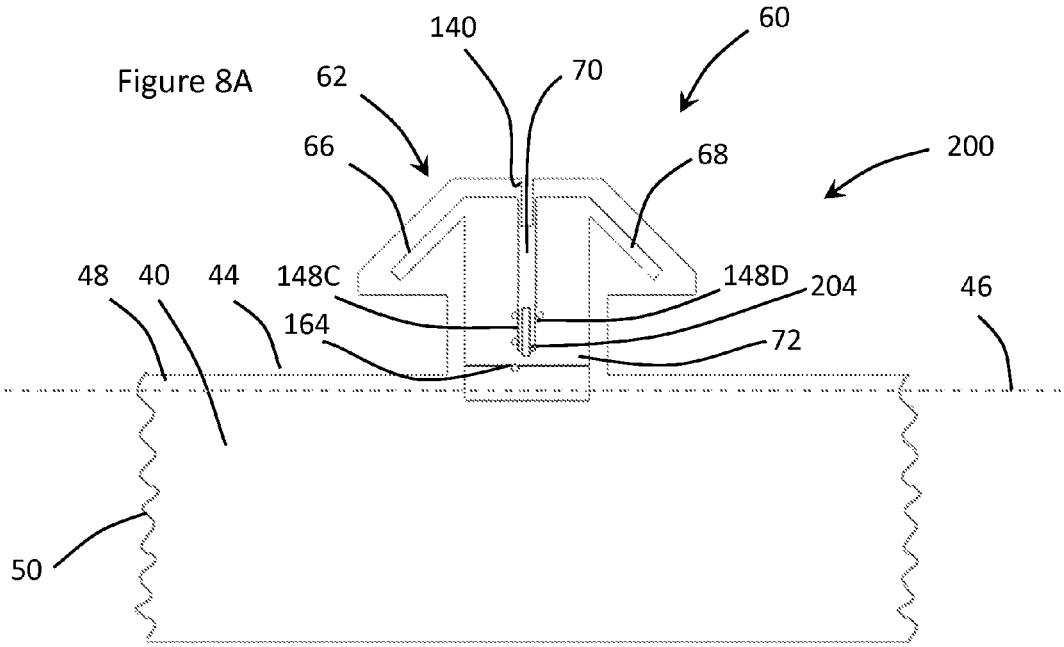
FIGS. 8A-8B respectively are plan views of one side of a portion of a second embodiment of a dipole card and the other side of the portion of the second embodiment of the dipole card.
Figure 8B:
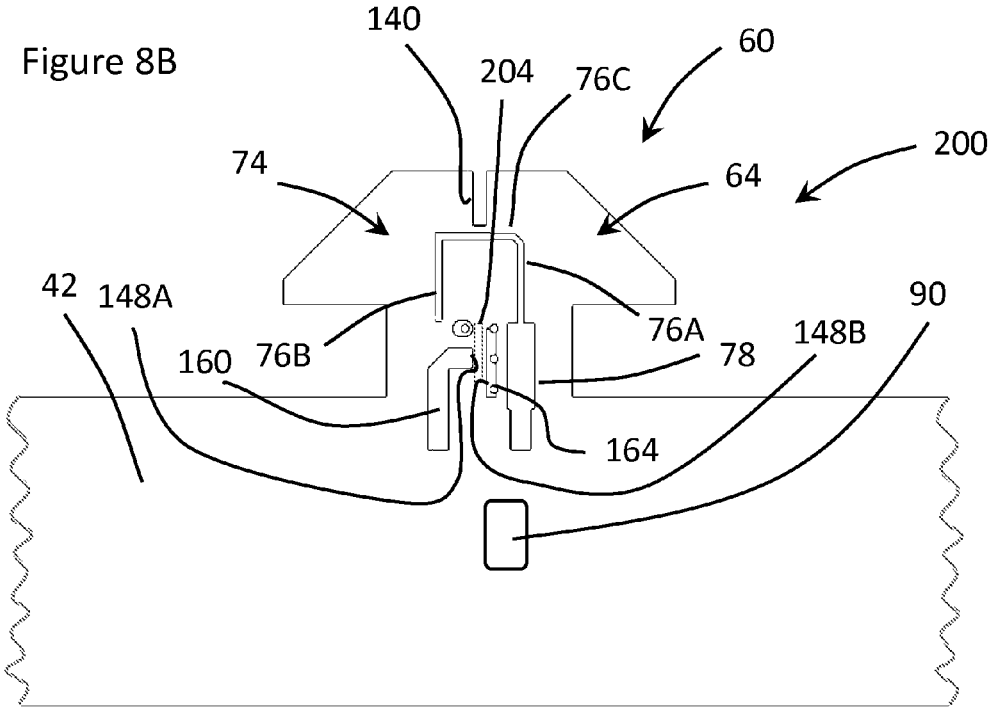
Figure 9A:
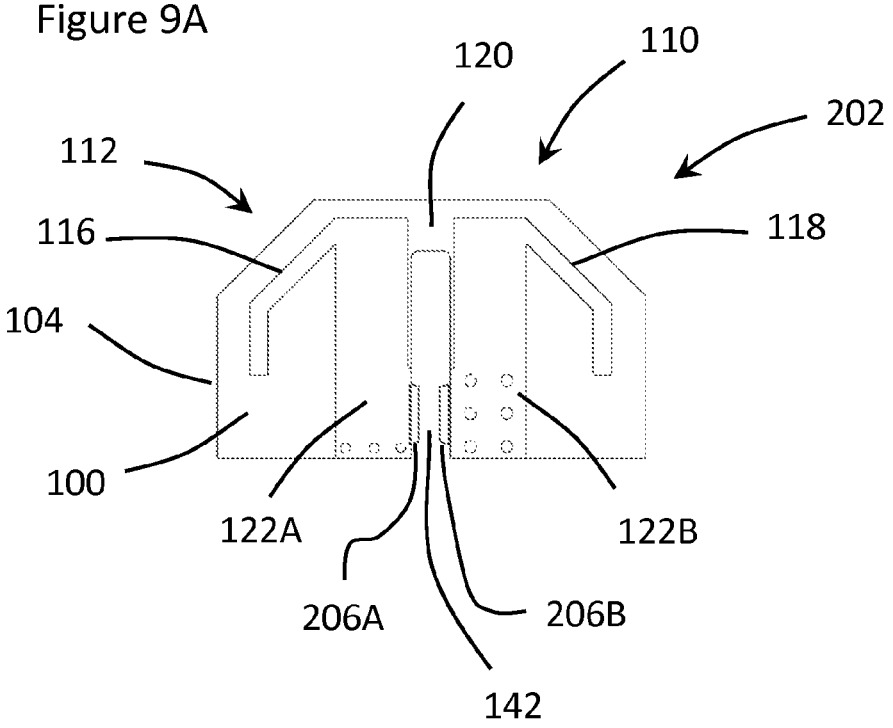
FIGS. 9A-9B respectively are plan views of one side of a second embodiment of a crossing dipole card for use with the second embodiment of the dipole card illustrated in FIGS. 8A and 8B and the other side of the second embodiment of the crossing dipole card.
Figure 9B:
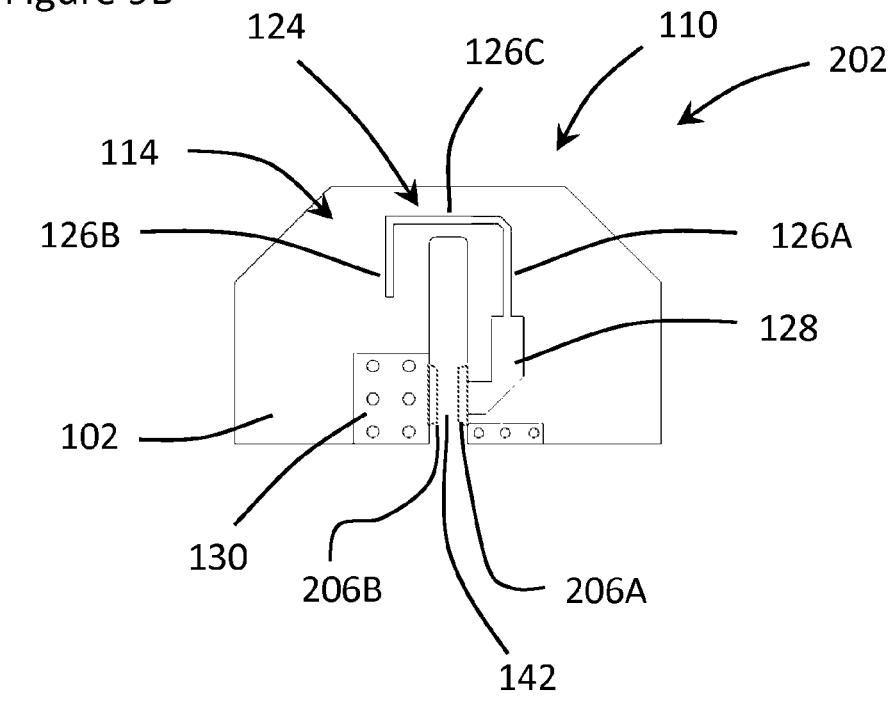

Each of the rails 148A-148B has a single planar surface that engages a single planar surface associated with the crossing dipole card 24. By modification of the location and/or shape of the surface of a card that is engaged by a rail and/or modification of the location and/or shape of a rail, two perpendicular planar surfaces of a rail can engage two perpendicular planar surfaces of the other card. Examples of such modifications are shown in FIG. 7. To elaborate, a first card 150 has rails 152A-152D and a second card 154 has lands 156A-156D. The rail 152A engages land 156A in the same manner as the rails shown in FIG. 6, i.e., one planar surface associated with the rail on one of the cards engages one planar surface associated with the other of the cards. In contrast, rail 152B has first planar surface that engages a first planar surface of the land 156B and a second planar surface that is perpendicular to the first planar surface of the rail 152B and engages a second planar surface of the second card 154. In this case the pair of rails 152A, 152B is separated by a distance that the sum of the thickness of the second card 154 and the thickness of the land 156A. The rails 152C, 152D each have first planar surfaces that respectively engage planar surfaces of lands 156C, 156D and second planar surfaces that respectively engage planar surfaces of the second card 154. In this case, the distance between the pair of rails 152C, 152D is slightly greater than the distance between the two parallel surfaces of the second card 154. Generally, the more rails that have two perpendicular planar surfaces that engage two opposing perpendicular planar surfaces, the greater the stability of the perpendicularity between the cards.

With reference to FIGS. 5A-5D and 6, the rails 148A-148D each serve at least one additional purpose in addition to facilitating the establishment of perpendicularity between the dipole card 22 and the crossing dipole card 24. To elaborate, the rail 148A is: (a) part of a third transmission line 160 that electrically connects the J-balun of the crossing dipole card 24 with electrical circuitry and/or electronics associated with the antenna feed portion 48 of the dipole card 22; (b) provides a metal surface that can be electrically connected to the metal surface of the second transmission line 128; and (c) provides a metal surface that is disposed immediately adjacent to the metal surface of the second transmission line 128 in corner 146A, thereby allowing an electrical connection to be established between the second transmission line 128 and the third transmission line 160 that also serves to maintain perpendicularity between the cards. With respect to (c), a first solder joint 162 or similar connection is established between the second transmission line 128 and the third transmission line 160 in corner 146A to make an electrical connection between the transmission lines. The solder joint 162 also establishes a fillet or chamfer-like structure between the cards that supports the desired perpendicularity between the cards. A solder joint is achieved using a fusible metal alloy or a conductive paste, each of which operating to establish a fillet or chamfer-like structure between the cards.

The rails 148B, 148C: (a) each provide metal surfaces for electrically connecting the pair of lands 122A, 122B via plated via holes 164 that pass through the dipole card 22, thereby completing the balun ground plane for the crossing dipole antenna; and (b) each provide a metal surface disposed immediately adjacent to a metal surface associated with the crossing dipole card 24 to allow an electrical connection to be established via soldering or a similar method that also establishes a mechanical connection which maintains perpendicularity between the cards. With respect to (b), a second solder joint 166 is established in corner 146B to electrically connect the rail 148B and land 122A and a third solder joint 168 is established in corner 146C to electrically connect the rail 148C and land 122B, thereby connecting lands 122A, 122B and completing the balun ground plane for the crossing dipole. Each of the solder joints 166, 168 also establishes a fillet or chamfer-like structure between the cards that supports the desired perpendicularity between the cards.

The three solder joints 162, 166, and 168 establish all of the electrical connections needed to realize a crossed-dipole antenna.

The rail 148D provides a metal surface disposed immediately adjacent to a metal surface associated with the crossing dipole card 24 to allow a solder or similar connection to be established in the corner 146D that forms a fillet or chamfer-like structure for maintaining perpendicularity between the cards. More specifically, a fourth solder joint 170 is established in corner 146D to mechanically connect the rail 148D and the land 130. The land 130 is electrically connected to land 122B by way of plated via holes. Consequently, an electrical connection is also established. However, this electrical connection is not necessary to the establishment of a crossed-dipole antenna. However, this electrical connection does establish a common balun ground plane between the two dipoles. The common balun ground plane is typically used to avoid relative phase shifts not present in the signal path, ground bounces in detector circuits, and the like. If these types of issues are not present in a particular embodiment, the electrical connection need not be made. The connection, even if not needed for electrical reasons, still provides a mechanical connection that facilitates perpendicularity between the cards.

The reflector 26 is a planar structure. However, a reflector that is non-planar is feasible. For instance, a reflector with cylindrical shape or curved shape is feasible if needed for a particular application. The reflector 26 is also disposed substantially perpendicular to the dipole card or cards supported by the frame 28. A reflector that is disposed other than perpendicular to one or more of the dipole cards being supported by frame 28 can be employed if needed by a particular application.

The frame 28 is capable of holding a plurality of dipole cards such that the cards are disposed substantially parallel to one another and the crossed-dipole antennas forming the array are disposed in a planar, grid-like manner. It should be appreciated that many other types of frames other than frame 28 are capable of supporting one or more dipole cards in this manner. Further, a frame that supports dipole cards such that dipole cards that are immediately adjacent to one another are disposed in a non-parallel manner is feasible. For instance, a frame that supports multiple dipole cards that are radially disposed is feasible. One such a frame for holding multiple cards disposes the crossed-dipole antennas forming the array in a planar, radial pattern. Another such frame for holding multiple cards disposes the crossed-dipole antennas forming the array in a cylindrical manner. Other frames for disposing the crossed-dipole antennas forming the array in whatever orientation is applicable to a particular application are feasible.

With reference to FIGS. 8A-8B and 9A-9B, second embodiments of a portion of a dipole card 200 and a crossing dipole card 202 are described. Generally, the dipole card 200 and crossing dipole card 202 have all the same features as the dipole card 22 and the crossing dipole card 24. As such, features of dipole card 200 that are common to dipole card 22 bear the same reference numbers. Likewise, feature of crossing dipole card 202 that are common to crossing dipole card 24 bear the same reference numbers. Dipole card 200 and crossing dipole card 202 implement a tab-and-hole structure for establishing sufficient perpendicularity between the cards to facilitate the implementation of solder joints that substantially fix the perpendicularity between the cards. The tab-and-hole structure supplements the rail structure when the crossed-dipole antennas are designed to operate at high frequencies (i.e., above X-band—greater than about 12 GHz). Typically, the tab-and-hole structure supplants the rail structure when the crossed-dipole antennas are designed to operate at lower frequencies (i.e., in the range of X-band and below—less than about 12 GHz) where the dimensions of the crossed-dipole antennas and spacing between the crossed-dipole antennas are larger. In such situations, the low profile of the rails in a rail structure is typically inadequate for establishing a reasonably stable perpendicularity between the cards prior to the establishment of solder joints to fix the perpendicularity.

The dipole card 200 defines a hole 204 that extends along the intersection line 144 between the dipole card 200 and crossing dipole card 202. The crossing dipole card 202 defines a pair of tabs 206A, 206B that are positioned to fit within hole 204 when the notch 140 of the dipole card 200 and the notch 142 of the crossing dipole card 202 are used to establish an "egg crate" engagement of the cards. The insertion of the tabs 206A, 206B into the hole 204 establishes a relatively stable perpendicularity between the cards. Subsequently, solder joints established in the corners created by the dipole card 200 and crossing dipole card 202, as previously described, substantially fix the perpendicularity between the cards. It should be appreciated that a single tab can be used in place of the pair of tabs 206A, 206B. Further, it is also feasible to reverse the locations of the hole and tab(s), namely, a hole can be established in the crossing dipole card and a tab(s) associated with the dipole card.

Figure 10:
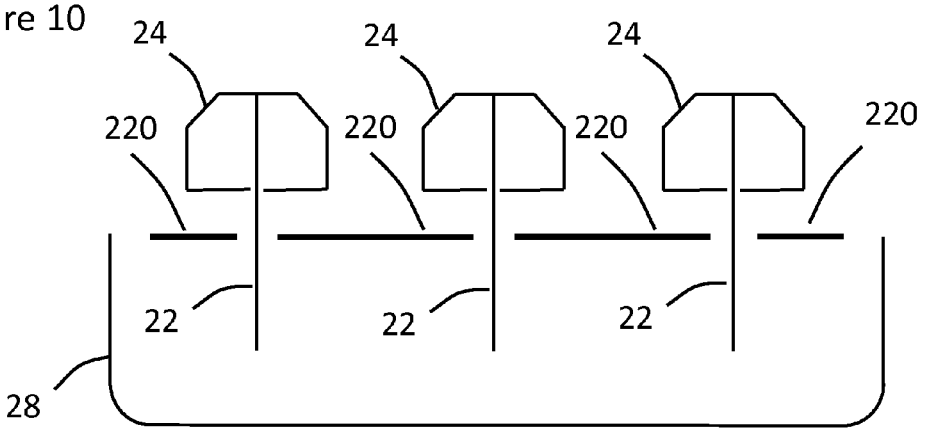
FIG. 10 is a cross-section of an embodiment of the crossed-dipole antenna structure that employs a composite reflector.

The reflector 26 illustrated in FIGS. 1 and 2 is a monolithic structure. In other embodiments of the crossed-dipole antenna structure, a reflector is realized by using a composite of a plurality of sub-reflectors. With reference to FIG. 10, in one embodiment of such a composite reflector, a plurality of sub-reflectors 220 are utilized with each sub-reflector substantially extending: (a) between two consecutive dipole cards 22 within the frame 28 or the locations at which two consecutive dipole cards 22 would be located if present in the frame 28 or (b) in the case of the two outermost dipole cards 22, between the dipole card and the frame 28 or between the locations at which the two outermost dipole cards would be located if present and the frame 28.

Figure 11:
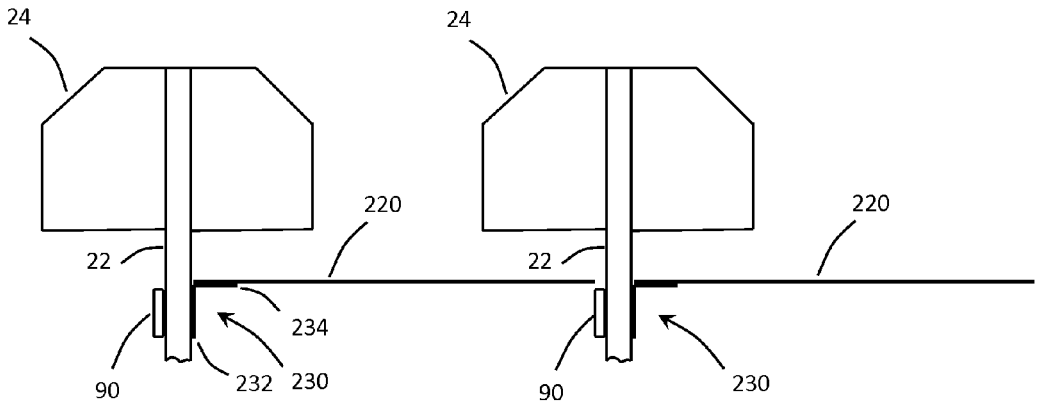
FIG. 11 illustrates another embodiment of the crossed-dipole antenna structure that employs a composite reflector comprised of sub-reflectors with certain sub-reflectors being operatively connected to a heat sink structure.

In certain embodiments of the crossed-dipole antenna structure, the power amplifier(s) 90 associated with each of the crossed-dipole antennas generates considerable heat that needs to be dissipated. With reference to FIG. 11, in one embodiment of the structure, the sub-reflectors 220 are utilized to dissipate the heat. To elaborate, a heat sink 230 is used to establish a thermal circuit between the amplifier 90 and one of the sub-reflectors 220. The heat sink 230 is made of a thermally conductive material (e.g., a metal) and has a first planar face 232 that is attached to the side of the dipole card 22 opposite to the location of the power amplifier 90. Located between the power amplifier 90 and the first planar face 232 is thermal circuitry that conducts heat produced by the amplifier through the dipole card 22 to the first planar face 232. Typically, this thermal circuitry includes a thermally conductive pad located between the power amplifier 90 and the surface of the dipole card and one or more thermally conductive structures that pass through the dipole card and conduct heat from the pad to a location on the other side of the dipole card where the heat can be received by the first planar face 232 of the heat sink 230. The heat sink 232 includes a second planar face 234 that is operatively connected to one of the sub-reflectors 220 to complete the thermal circuit. Due to this thermal circuit, heat produced by the power amplifier 90 is dissipated by one of the sub-reflectors. Additionally, the connection of the dipole card 22 with its associated crossing dipole cards 24 and one of the sub-reflectors 220 via the heat sink 230 creates a modular antenna structure that can be used to quickly build up crossed-dipole antenna array structures.

Figure 12:
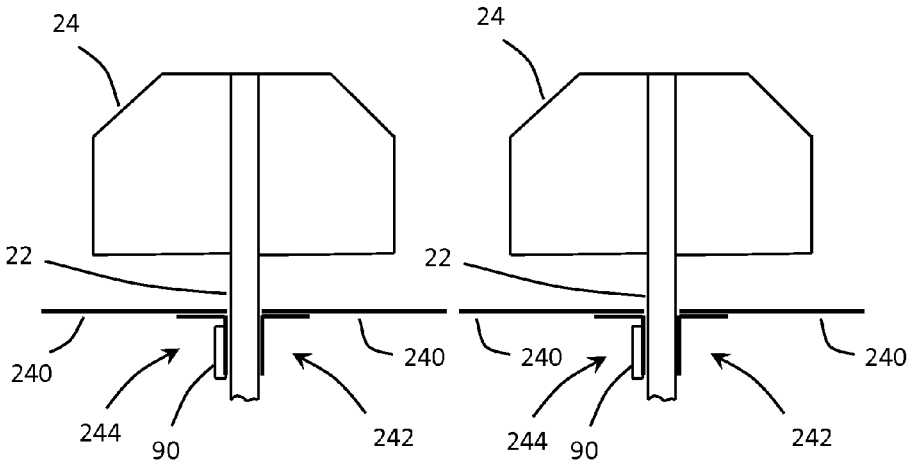
FIG. 12 illustrates another embodiment of a crossed-dipole antenna structure that employs a composite reflector comprised of sub-reflectors with certain sub-reflectors being operatively connected to a heat sink structures.
Figure 13A:
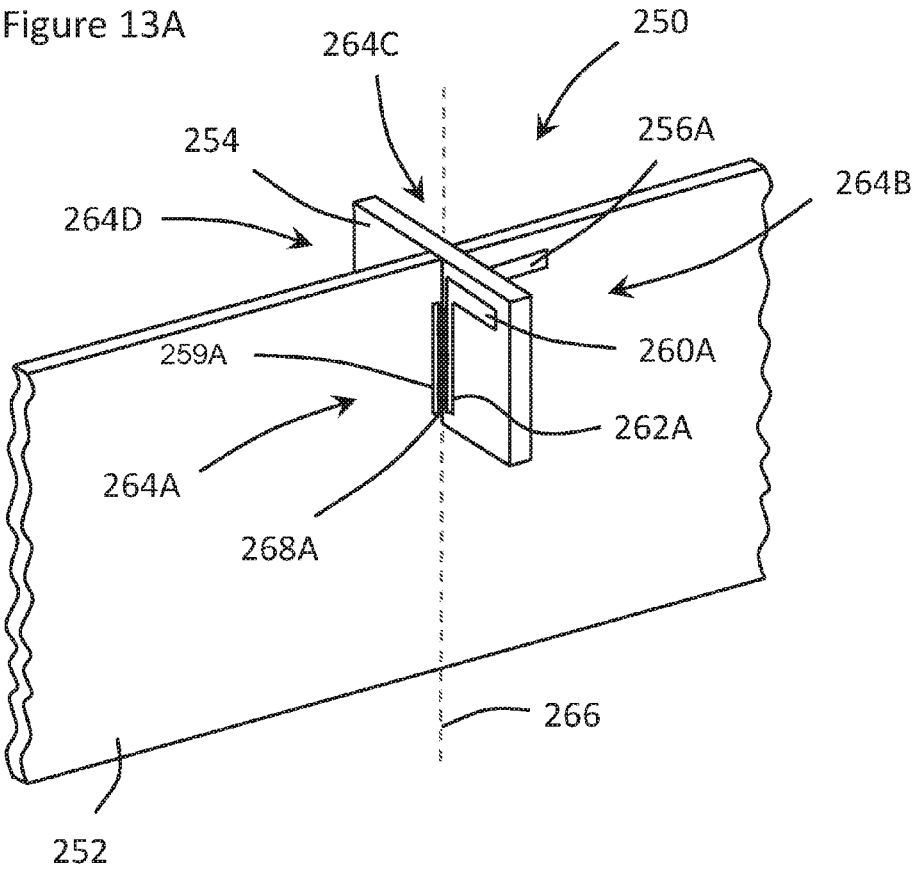
FIGS. 13A-13D are perspective views on each of the four corners of a crossed-dipole antenna formed by a third embodiment of a portion of a dipole card and a secondthird embodiment of one of the crossing dipole cards.
Figure 13B:
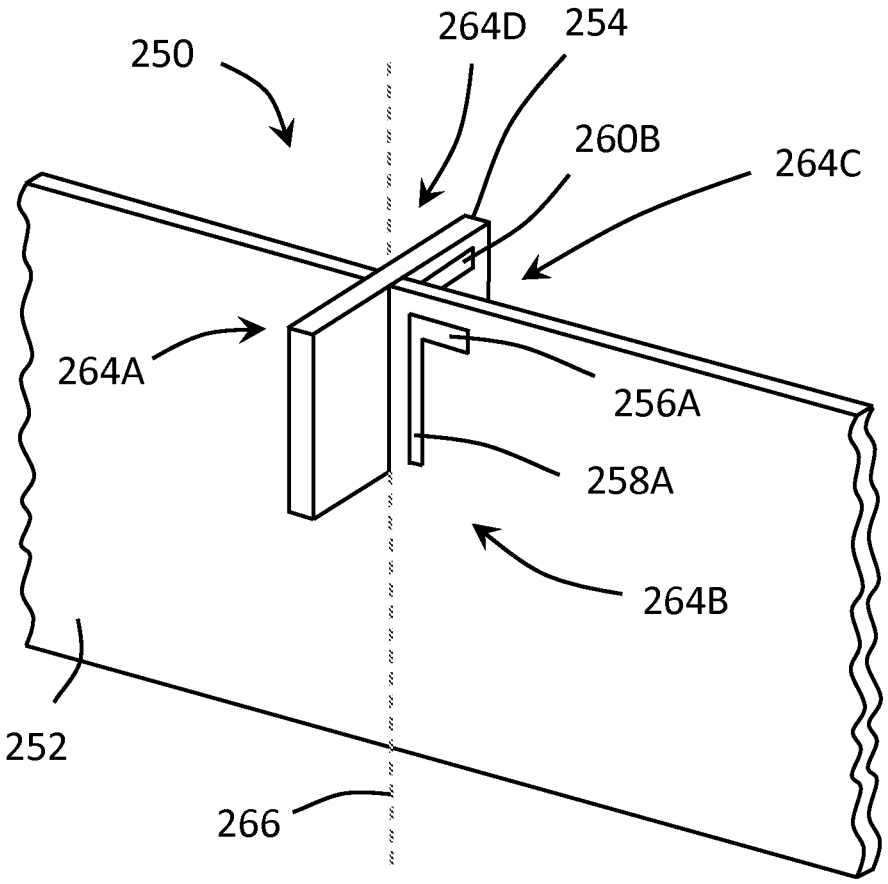
Figure 13C:
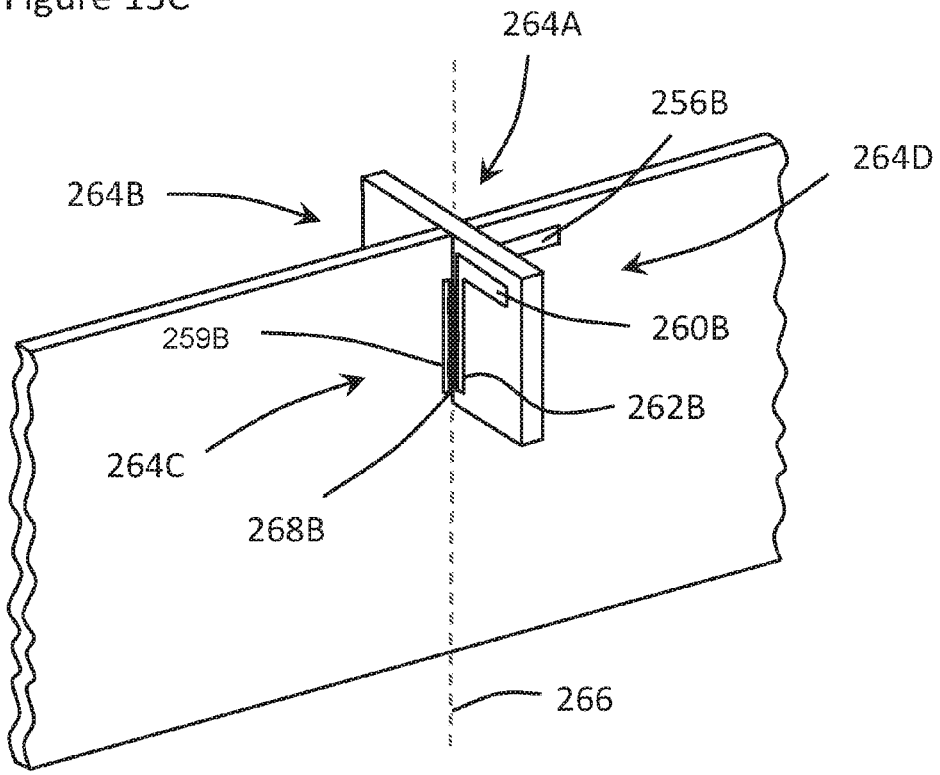
Figure 13D:
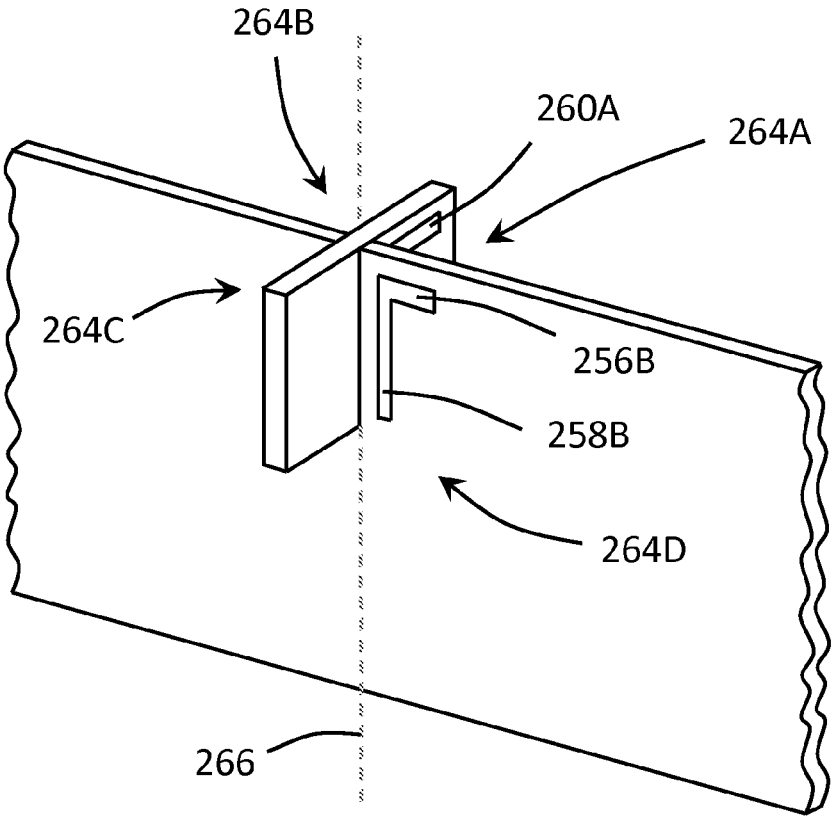
Figure 14:
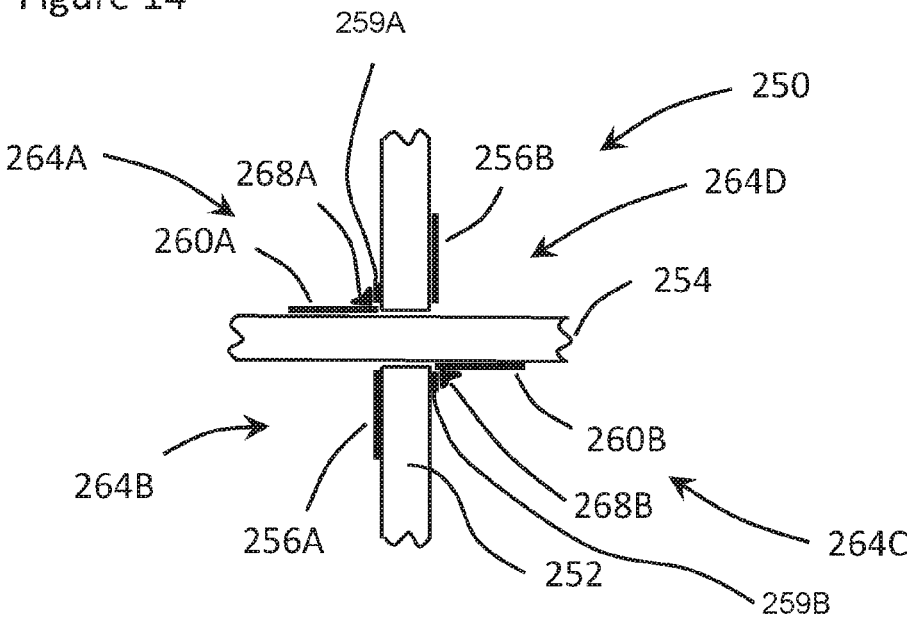
FIG. 14 is a top view of the crossed-dipole antenna illustrated in FIGS. 13A-13D.
Figure 15A:
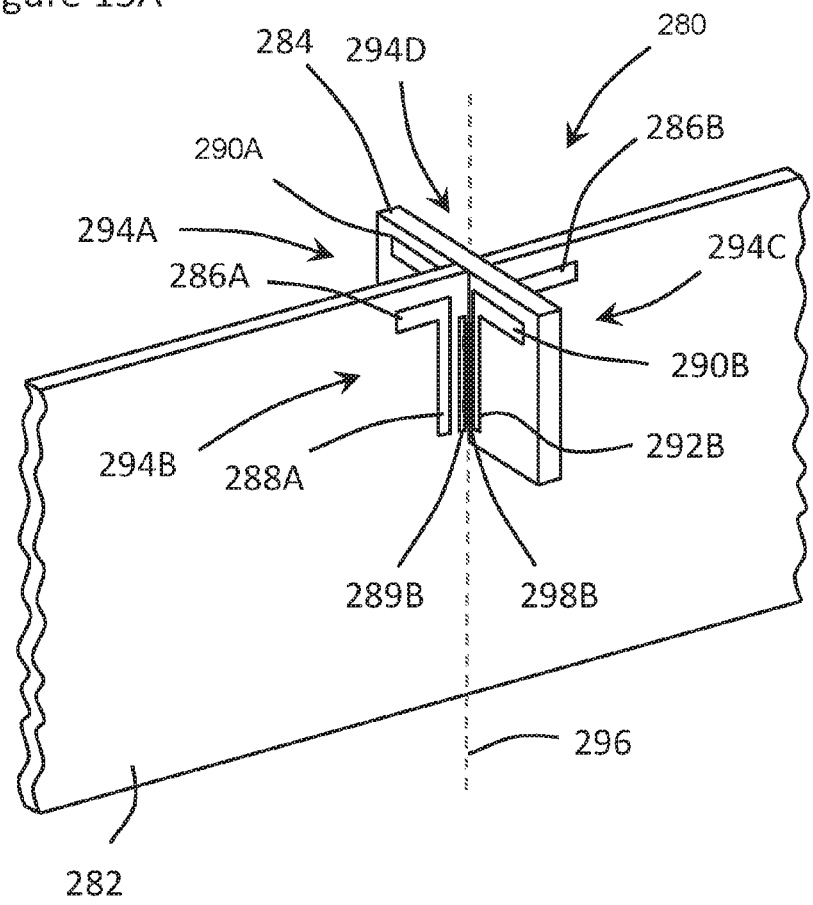
FIGS. 15A-15D are perspective views on each of the four corners of a crossed-dipole antenna formed by a fourth embodiment of a portion of a dipole card and a fourth embodiment of one of the crossing dipole cards.
Figure 15B:
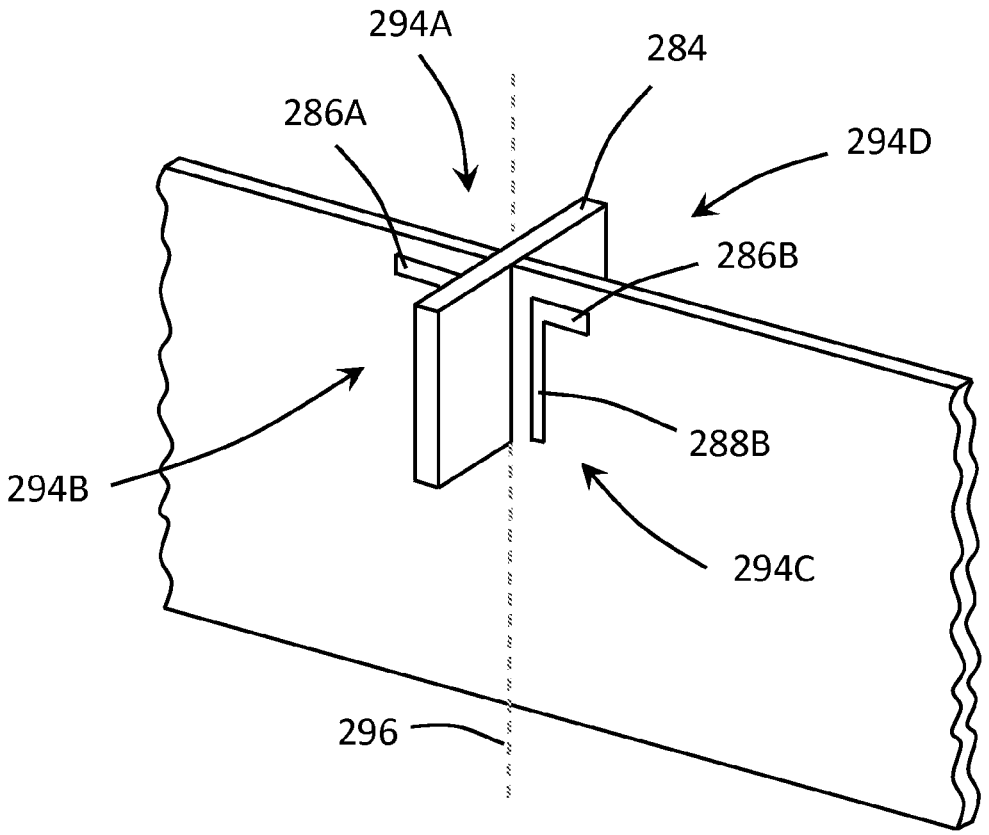
Figure 15C:
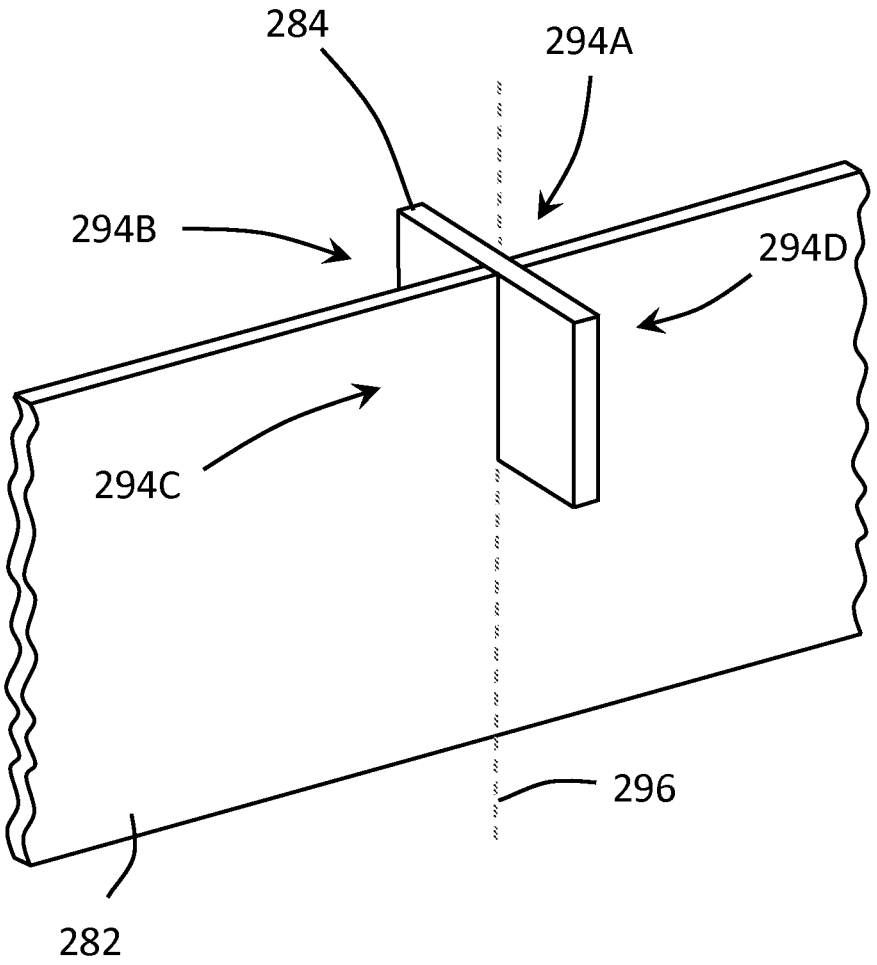
Figure 15D:
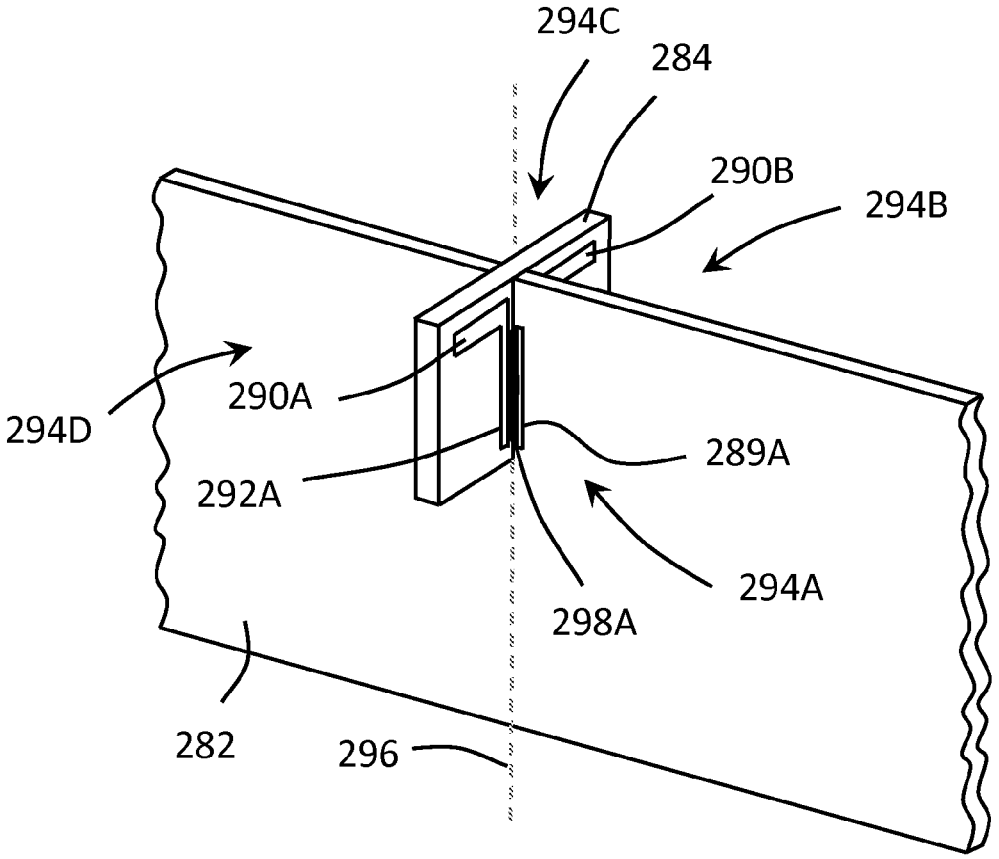
Figure 16:
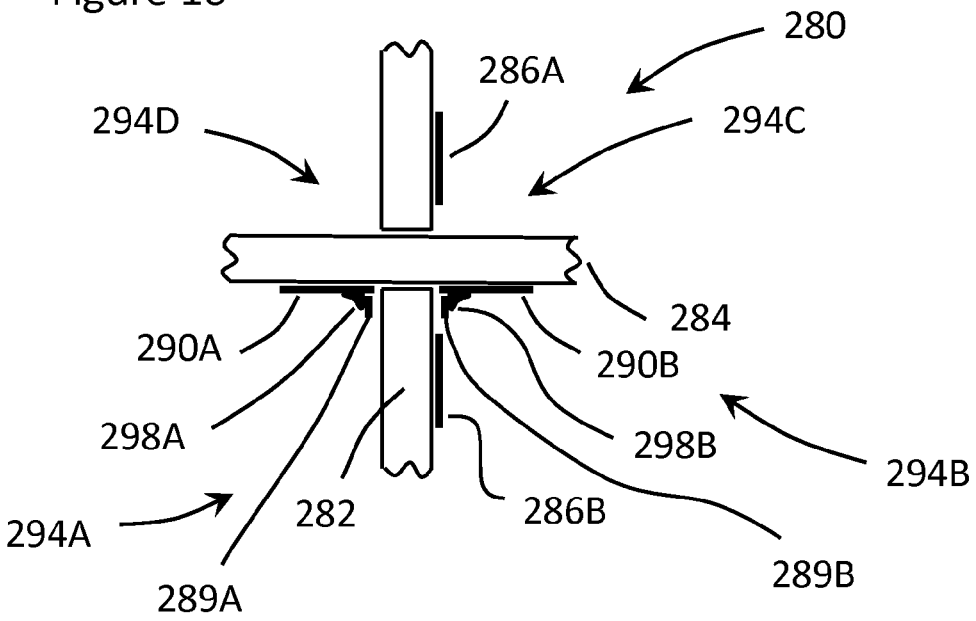
FIG. 16 is a top view of the crossed-dipole antenna illustrated in FIGS. 15A-15D.

With reference to FIG. 12, another embodiment of the reflector employs sub-reflectors 240 with one such sub-reflector located on each side of a dipole card 22 or the location at which a dipole card 22 would be located if present in the frame 28. A heat sink 242 is used to complete a heat circuit between the power amplifier(s) 90 associated with each crossed-dipole and one of the sub-reflectors 240 in substantially the same manner as described with respect to heat sink 230. The heat sink 242 also mechanically connects one side of the dipole card 22 to one of the sub-reflectors 240. A connector 244, which may or may not operate as a heat sink, connects the other side of a dipole card 22 to a second sub-reflector 240. The connection of the dipole card 22 with its associated crossing dipole card 24 to the two sub-reflectors 240 via the heat sink 242 and connector 244 creates a modular antenna structure that can be used to quickly build up crossed-dipole antenna array structures.

With reference to FIGS. 13A-13D and 14, a crossed-dipole antenna comprised of third embodiments of a dipole card and a crossing dipole card that require only two solder joints to establish the crossed dipole antenna is described. A crossed-dipole antenna 250 is comprised of a dipole card 252 (only a portion shown) and a crossing dipole card 254.

The dipole card 252 supports a dipole antenna that is located on the antenna portion of the card and comprised of two radiator arms 256A, 256B which are located on opposite sides of the dipole card 252. The two radiators arms 256A, 256B of the dipole antenna are respectively fed with leads 258A, 258B, which together form a twin lead feed or balanced feed. As such, there is no balun for the dipole antenna located in the antenna portion of the card. A balun for the dipole antenna may, however, be located in the antenna feed portion of the card. The leads 258A, 258B are connected to feed circuitry located on/in the antenna feed portion of the card by transmission lines or similar structures (not shown). A pair of lands 259A, 259B are located on opposite sides of the dipole card 252 and are used to electrically connect the crossing dipole to feed circuitry located on/in the antenna feed portion of the dipole card 252 and to mechanically connect the dipole card 252 and the crossing dipole card 254.

The crossing dipole card 254 supports a crossing dipole antenna that is comprised of two radiator arms 260A, 260B that are located on opposite sides of the crossing dipole card 254. The two radiators arms 260A, 260B of the dipole antenna are respectively fed with leads 262A, 262B, which together form a twin lead feed or balanced feed. As such, there is no balun or portion of a balun located on the crossing dipole card 254. A balun for the crossing dipole may, however, be located in the antenna feed portion of the dipole card 252.

The dipole card 252 and the crossing dipole card 254 each have notches (not shown) that allow the cards to be engaged in an egg-crate fashion. The engagement of the cards defines corners 264A-264D and an intersection volume represented by line 266.

To establish the electrical connections between the crossing dipole antenna with leads 262A, 262B located on the crossing dipole card 254 and the supporting feed circuitry for the crossing dipole antenna on the dipole card 252, two solder joints 268A, 268B are employed. The solder joint 268A electrically connects the lead 262A of the crossing dipole antenna to the land 259A, which is connected to feed circuitry located on the antenna feed portion of the dipole card 252. The solder joint 268B electrically connects the lead 262B of the crossing dipole antenna to the land 259B, which is connected to feed circuitry located on the antenna feed portion of the dipole card 252. The solder joints 268A, 268B, in addition to establishing the noted electrical connections, also mechanically connect the dipole card 252 and the crossing dipole card 254 and fix the perpendicularity between the cards.

It should be appreciated that the establishment of perpendicularity between the dipole card 252 and a crossing dipole card 254 can be facilitated by the use of one or more rail structures of the type discussed with respect to FIGS. 5A-5D, 6, and 7 and/or the use of a tab-and-hole structure of the type discussed with respect to FIGS. 8A-8B and 9A-9B.

With reference to FIGS. 15A-15D and 16, a crossed-dipole antenna comprised of fourth embodiments of a dipole card and a crossing dipole card that require only two solder joints to establish the crossed dipole antenna is described. A crossed-dipole antenna 280 is comprised of a dipole card 282 (only a portion shown) and a crossing dipole card 284. The dipole card 282 supports a dipole antenna that is located on the antenna portion of the card and comprised of two radiator arms 286A, 286B which are located on the same side of the dipole card 282. The two radiators arms 286A, 286B of the dipole antenna are respectively fed with leads 288A, 288B, which together form a twin lead feed or balanced feed. As such, there is no balun for the dipole antenna located in the antenna portion of the card. A balun for the dipole antenna may, however, be located in the antenna feed portion of the card. The leads 288A, 288B are connected to feed circuitry located on/in the antenna feed portion of the card by transmission lines or similar structures (not shown). A pair of lands 289A, 289B are located on opposite sides of the dipole card 282 and are used to electrically connect the crossing dipole to feed circuitry located on/in the antenna feed portion of the card and to mechanically connect the dipole card 282 and the crossing dipole card 284.

The crossing dipole card 284 supports a crossing dipole antenna that is comprised of two radiator arms 290A, 290B that are located on the same side of the crossing dipole card 284. The two radiators arms 290A, 290B of the dipole antenna are respectively fed with leads 292A, 292B, which together form a twin lead feed or balanced feed. As such, there is no balun or portion of a balun located on the crossing dipole card 284. A balun for the crossing dipole may, however, be located in the antenna feed portion of the dipole card 282.

The dipole card 282 and the crossing dipole card 284 each have notches (not shown) that allow the cards to be engaged in an egg-crate fashion. The engagement of the cards defines corners 294A-294D and an intersection volume represented by line 296.

To establish the electrical connections between the crossing dipole antenna with leads 292A, 292B located on the crossing dipole card 284 and the supporting feed circuitry for the crossing dipole antenna on the dipole card 282, two solder joints 298A, 298B are employed. The solder joint 298A electrically connects the lead 292A of the crossing dipole antenna to the land 289A, which is connected to feed circuitry located on the antenna feed portion of the dipole card 282. The solder joint 298B electrically connects the lead 292B of the crossing dipole antenna to the land 289B, which is connected to feed circuitry located on the antenna feed portion of the dipole card 282. The solder joints 298A, 298B, in addition to establishing the noted electrical connections, also mechanically connect the dipole card 282 and the crossing dipole card 284 and fix the perpendicularity between the cards.

It should be appreciated that the establishment of perpendicularity between the dipole card 282 and a crossing dipole card 284 can be facilitated by the use of one or more rail structures of the type discussed with respect to FIGS. 5A-5D, 6, and 7 and/or the use of a tab-and-hole structure of the type discussed with respect to FIGS. 8A-8B and 9A-9B.

Figure 17:
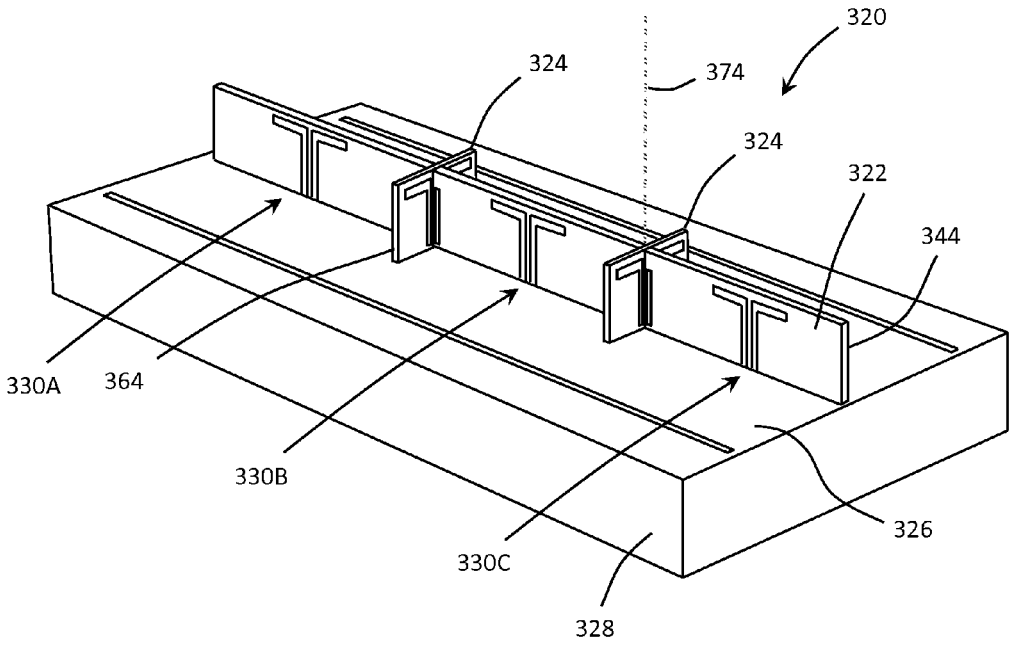
FIG. 17 illustrates a second embodiment of a crossed-dipole antenna array structure comprised of a dipole card, a plurality of crossing dipole cards operatively attached to the dipole card, a reflector, and a frame for supporting the dipole card and the reflector.

With reference to FIG. 17, a second embodiment of a crossed-dipole antenna array structure 320 (hereinafter structure 320) is described. Generally, the structure 320 is comprised of a dipole card 322, a plurality of crossing dipole cards 324, a reflector 326, and a frame 328.

With reference to FIGS. 18A, 18B, 19A, and 19B and continuing reference to FIG. 17, the dipole card 322 supports a plurality of dipole antennas 330A-330C. Each of the crossing dipole cards 324 supports a crossing dipole antenna 324. Additionally, each of the crossing dipole antenna cards 324 is disposed substantially perpendicular to the dipole card 322 and in between two of the dipole antennas 330A-330C. Each crossing dipole antenna associated with one of the crossing dipole cards 324 cooperates with one or two of the dipole antennas 330A-330C between which the crossing dipole antenna is located to form a crossed-dipole antenna. The operative association of all of the crossing dipole cards 324 with the dipole card 322 produces an array of crossed-dipole antennas. The reflector 326 serves to restrict the radiation produced by or received by the array of crossed-dipole antennas to a single hemisphere (i.e., the hemisphere located on same side of the reflector 326 as the antenna array) and is located such that the array of crossed-dipole antennas is located on one side of the reflector and a substantial portion of the dipole card 322 is located on the other side of the reflector. This substantial portion of the dipole card 322 supports circuitry and/or electronic devices that are used in processing a signal provided to or received from each of the crossed dipole antennas in the array. The frame 328 generally serves to support the dipole card and the crossing dipole cards operatively associated with the dipole card in a preferred orientation and, more typically, to support a plurality of dipole cards and related crossing dipole cards in preferred orientations to one another. In this regard, the frame 328 is capable of supporting a plurality of dipole cards such that the cards are disposed substantially parallel to one another and so that the array of crossed-dipole antennas associated with the plurality of dipole cards lies in a plane. The frame 328 also serves to support the reflector 326 such that the reflective surface of the reflector 326 is substantially perpendicular to the dipole card(s) supported by the frame.

Figure 18A:
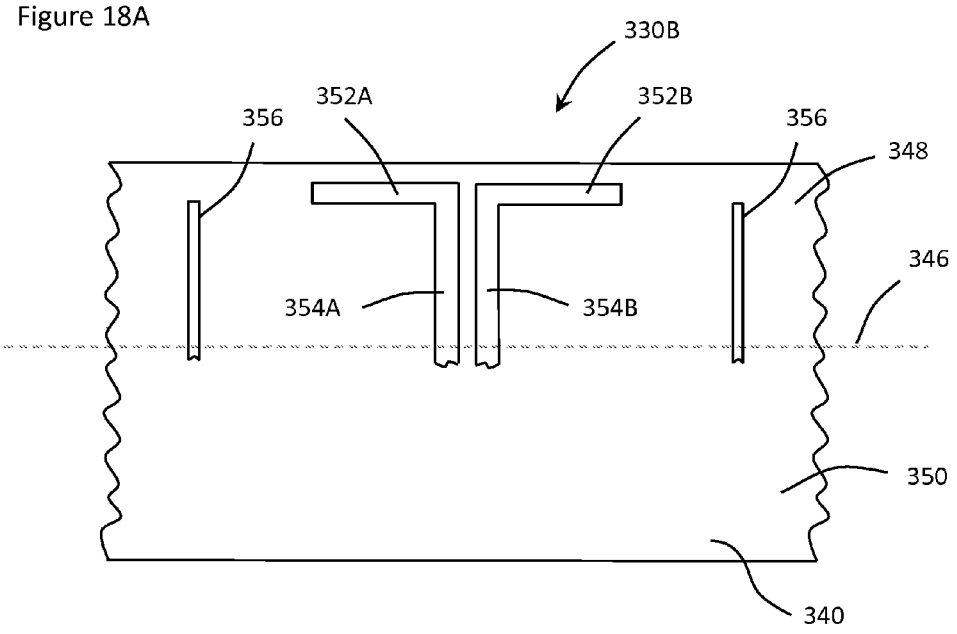
FIGS. 18A and 18B respectively are plan views of one side of a portion of the dipole card and the other side of the portion of the dipole card for the second embodiment of the crossed-dipole antenna array structure shown in FIG. 17.
Figure 18B:
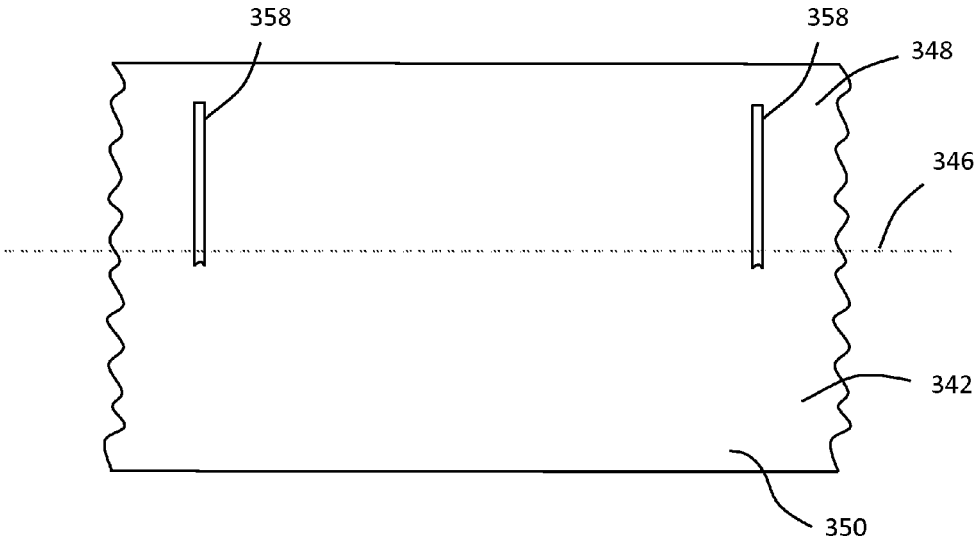

With reference to FIGS. 18A and 18B, the dipole card 322 has a first dipole card surface 340, a second dipole card surface 342 that is substantially parallel to the first dipole card surface 340, and a dipole card edge 344 that extends between the surfaces 340, 342. A reflector line 346 defines the location of the upper surface of the reflector 326 in the assembled structure 320. Additionally, the reflector line 346 divides the dipole card 322 into an antenna portion 348 and an antenna feed portion 350. Each of the dipole antennas 330A-330C associated with the dipole card 322 has first and second radiator arms 352A, 352B and leads 354A, 354B, which together form a twin lead feed or balanced feed. The leads 354A, 354B are operatively connected to circuitry/electronics located in/on the antenna feed portion 350 of the card. The dipole card 322 also has a plurality of lands 356 located on the first dipole card surface 340, each for connecting a crossing dipole antenna associated with a crossing dipole card 324 with circuitry/electronics located in/on the antenna feed portion of the card. The dipole card 322 also has a plurality of lands 358 located on the second dipole card surface 342, each for connecting a crossing dipole antenna associated with a crossing dipole card 324 with circuitry/electronics located in/on the antenna feed portion of the card.

Figure 19A:
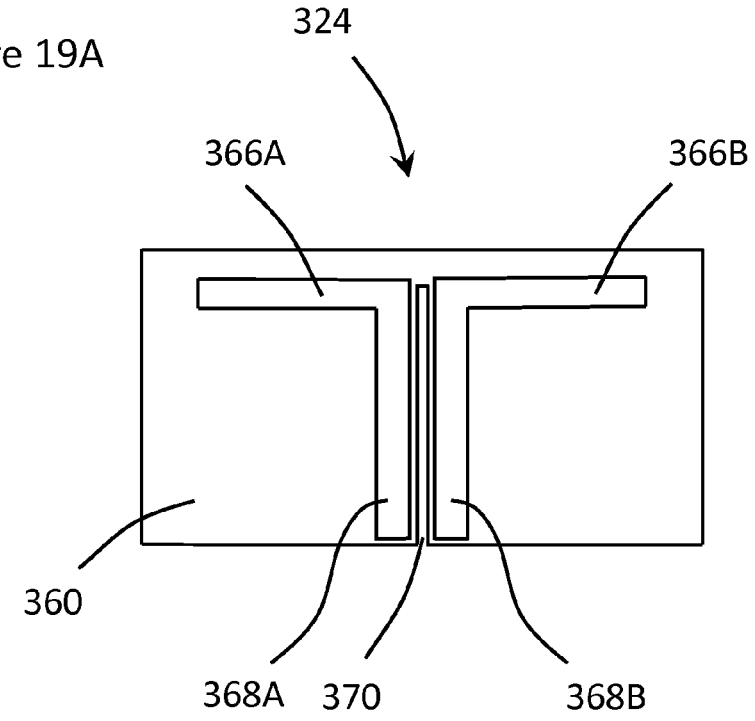
FIGS. 19A and 19B respectively are plan views of one side of the crossing dipole card for the second embodiment of the crossed-dipole antenna array structure shown in FIG. 17 and the other side of the crossing dipole card.
Figure 19B:
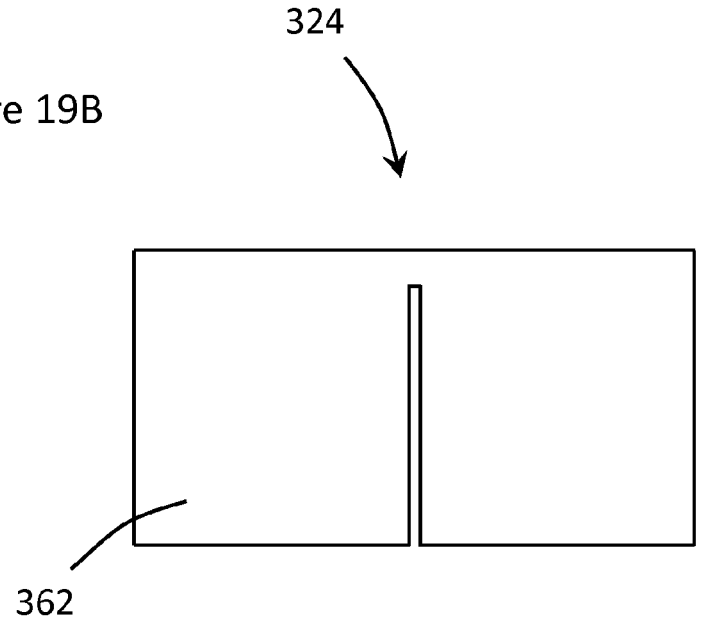

With reference to FIGS. 19A and 19B, the crossing dipole card 324 has a first crossing dipole card surface 360, a second crossing dipole card surface 362 that is substantially parallel to the first dipole card surface 360, and a dipole card edge 364 that extends between the surfaces 360, 362. The crossing dipole antenna associated with each of the crossing dipole cards 324 is comprised of two radiator arms 366A, 366B that are located on the first crossing dipole card side 360 of the crossing dipole card 324. The two radiators arms 366A, 366B of the crossing dipole antenna are respectively fed with leads 368A, 368B, which together form a twin lead feed or balanced feed.

Figure 20:
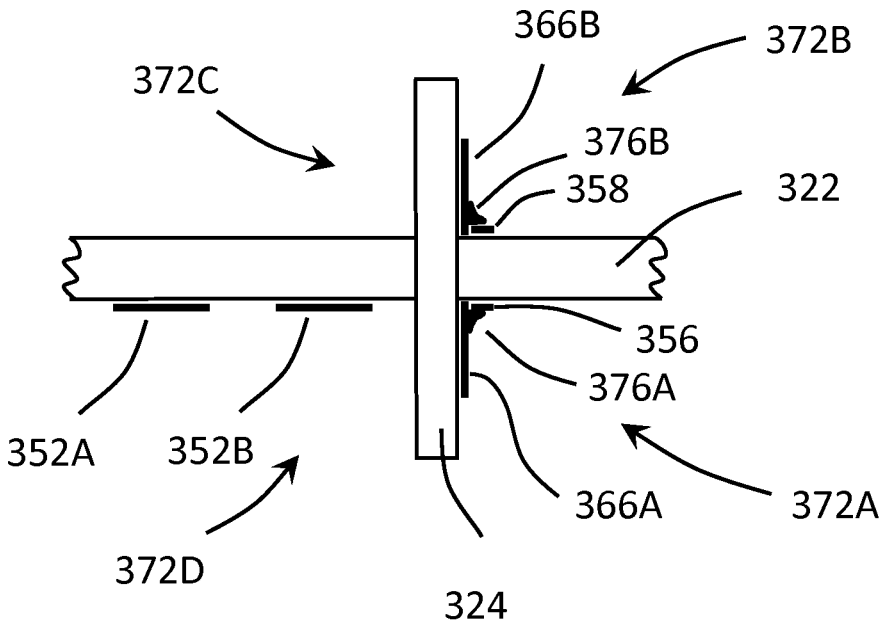
FIG. 20 is a top view of one of the crossed-dipole antennas associated with the second embodiment of the crossed-dipole antenna array structure shown in FIG. 17.

Each of the crossing dipole cards 324 has a notch 370 that allows the card to engage the dipole card 322 in a modified egg-crate fashion. The use of a single notch allows additional degrees of freedom of movement between a dipole card 322 and a crossing dipole card 324 relative to the two notch approach. However, if needed, the modified egg-crate approach can be supplemented with a rail structure and/or hole-and-notch structure to facilitate the establishment of perpendicularity between a crossing dipole card 324 and the dipole card 322. With reference to FIG. 20, the engagement of the dipole card 322 and one of the crossing dipole cards 324 defines corners 372A-372D and an intersection volume represented by line 374.

To establish the electrical connections between the crossing dipole antenna with leads 368A, 368B located on the crossing dipole card 324 and the supporting feed circuitry for the crossing dipole antenna on the dipole card 322, two solder joints 376A, 376B are employed. The solder joint 376A electrically connects the lead 368A of the crossing dipole antenna to the land 356, which is connected to feed circuitry located on the antenna feed portion of the dipole card 322. The solder joint 376B electrically connects the lead 368B of the crossing dipole antenna to the land 358, which is connected to feed circuitry located on the antenna feed portion of the dipole card 322. The solder joints 376A, 376B, in addition to establishing the noted electrical connections, also mechanically connect the dipole card 322 and the crossing dipole card 324 and fix the perpendicularity between the cards. It should be appreciated that lands similar to lands 356, 358 can be disposed on the dipole card 322 such that these additional lands are located on the other side of the crossing dipole card 324 and lands disposed on the crossing dipole card 324 to facilitate the establishment of additional solder joints in the other corners. Further, it is feasible to plate the notch 370 such the lands are connected, thereby providing a greater surface area for the solder joints.

It should be appreciated that a balun structure can be used in place of the twin lead feed associated with the dipole antennas and/or crossing dipole antennas. If a balun is used with the crossing dipole antennas, the dipole card and crossing dipole cards can be modified to implement structures similar to those discussed with respect to FIGS. 3A, 3B, 4A, and 4B in which three solder joints are used to electrically connect a crossing dipole antenna to circuitry/electronics located on/in the antenna feed portion of the dipole card.

It should be appreciated that the establishment of perpendicularity between the dipole card 322 and a crossing dipole card 324 can be facilitated by the use of one or more rail structures of the type discussed with respect to FIGS. 5A-5D, 6, and 7 and/or the use of a tab-and-hole structure of the type discussed with respect to FIGS. 8A-8B and 9A-9B.

The foregoing description of the invention is intended to explain the best mode known of practicing the invention and to enable others skilled in the art to utilize the invention in various embodiments and with the various modifications required by their particular applications or uses of the invention.

What is claimed is:

1. A crossed-dipole antenna array structure comprising:

a dipole card having a first dipole card surface, a second dipole card surface that is separated from and substantially parallel to the first surface, and a dipole card edge that extends between the first dipole card surface and the second dipole card surface and defines the lateral extent of the dipole card;

wherein a reflector line defines the position of a reflector surface disposed adjacent to the dipole card and extends between a first location on the dipole card edge and a second location on the dipole card edge;

wherein the dipole card includes an antenna portion that is located to one side of the reflector line and an antenna feed portion that is located to other side of the reflector line;

wherein multiple dipole antennas are associated with the dipole card, located in the antenna portion of the dipole card, and extend outward from the first dipole card surface and/or second dipole card surface;

a plurality of crossing dipole cards with each of the plurality of crossing dipole cards associated with one of the multiple dipole antennas of the dipole card;

wherein each of the plurality of crossing dipole cards has a first crossing dipole card surface, a second crossing dipole card surface that is separated from and substantially parallel to the first crossing dipole card surface, and a crossing dipole card edge that extends between the first crossing dipole card surface and the second crossing dipole card surface and defines the lateral extent of the crossing dipole card;

wherein each of the plurality of crossing dipole cards has at least a portion of a crossing dipole antenna that extends outward from the first crossing dipole card surface and/or second crossing dipole card surface;

wherein each of the crossing dipole cards extends substantially perpendicular to the dipole card;

wherein each of the at least a portion of a crossing dipole antenna associated with one of the crossing dipole cards is combined with one of the multiple dipole antennas associated with the dipole card to form a crossed-dipole antenna that is located on the same side of the reflector line as the antenna portion of the dipole card;

wherein the plurality of crossed-dipole antennas form an array of crossed-dipole antennas;

wherein each of crossing dipole cards and the dipole card define an intersection line and, when viewed from the same perspective and in a clockwise direction, consecutively define first, second, third, and fourth corners;

wherein a plurality of electrical connections are established between each of the crossing dipole cards and the dipole card by multiple solder joints with each solder joint located in one of the first, second, third, and fourth corners;

circuitry/electronics for processing an electrical signal to be provided to or received from each of the crossed-dipole antennas, the circuitry/electronics located in and/or on the antenna feed portion of the dipole card;

a reflector with a reflector surface that extends along the reflector line; and a frame for supporting the dipole card, crossing dipole cards, and the reflector.

2. A crossed-dipole antenna array structure, as claimed in claim 1, wherein:

the multiple solder joints include three solder joints with each of the three solder joints located in a different one of the first, second, third, and fourth corners than the other two solder joints.

3. A crossed-dipole antenna array structure, as claimed in claim 2, wherein:

one of the three solder joints establishes an electrical connection between a conductor of a balun associated with a crossing dipole card and a transmission line associated with the dipole card.

4. A crossed-dipole antenna array structure, as claimed in claim 2, wherein:

two of the three solder joints establish an electrical connection between a pair of lands of a balun ground plane associated with a crossing dipole card.

5. A crossed-dipole antenna array structure, as claimed in claim 1, wherein:

at least one of the multiple solder joints establishes a fillet/chamfer structure between a crossing dipole card and the dipole card.

6. A crossed-dipole antenna array structure, as claimed in claim 1, wherein:

each of the multiple solder joints is located in a different corner than at least two other of the multiple solder joints.

7. A crossed-dipole antenna array structure, as claimed in claim 1, wherein:

the dipole card edge of the dipole card defines a plurality of dipole card notches that each extends along one of the intersection lines and in which a portion of one of the plurality of crossing dipole cards is located; and/or the crossing dipole card edge of each of the plurality of crossing dipole cards defines a crossing dipole card notch that extends along one of the intersection lines and in which a portion of the dipole card is located.

8. A crossed-dipole antenna array structure, as claimed in claim 7, wherein:

the combination of the dipole card and each crossing dipole card having at least two parallel rails that each extend parallel to the intersection line defined by the dipole antenna card and the relevant one of the crossing dipole card and contribute to disposing each of the crossing dipole cards substantially perpendicular to the dipole card;

wherein each of the at least two parallel rails extends away from one of first dipole card surface, second dipole card surface, first crossing dipole card surface, and second crossing dipole card surface.

9. A crossed-dipole antenna array structure, as claimed in claim 8, wherein:

the at least two parallel rails respectively are located in two consecutive corners of the first, second, third, and fourth corners.

10. A crossed-dipole antenna array structure, as claimed in claim 8, wherein:

the at least two parallel rails are associated with one of: (a) the dipole card and (b) the crossing dipole card.

11. A crossed-dipole antenna array structure, as claimed in claim 8 wherein:

the first and second dipole card surfaces are separated by a dipole card distance;

the first and second crossing dipole card surfaces are separated by a crossing dipole card distance;

each of the multiple dipole antennas extends above the first and second dipole card surfaces by a cumulative dipole distance;

each of the crossing dipole antennas extends above the first and second crossing dipole card surface by a cumulative crossing dipole distance;

the distance between the two parallel rails has a range that is between: (a) slightly greater than the sum of the dipole card distance and cumulative dipole distance and slightly greater than the dipole card distance and (b) slightly greater than the sum of the crossing dipole card distance and cumulative crossing dipole distance and slightly greater than the crossing dipole card distance.

12. A crossed-dipole antenna array structure, as claimed in claim 8 wherein:

the combination of the dipole card and each crossing dipole card having at least four parallel rails that each extend parallel to the intersection line defined by the dipole antenna card and the relevant one of the crossing dipole card and contribute to disposing each of the crossing dipole cards substantially perpendicular to the dipole card;

wherein each of the at least four parallel rails extends away from one of first dipole card surface, second dipole card surface, first crossing dipole card surface, and second crossing dipole card surface.

13. A crossed-dipole antenna array structure, as claimed in claim 12, wherein:

each of at least three of the at least four parallel rails are electrically conductive and a portion of one of the dipole antenna and crossing dipole antenna of one of the crossed-dipole antennas.

14. A crossed-dipole antenna array structure, as claimed in claim 12, wherein:

each of at least three of the at least four parallel rails provides a solder surface for a different one of the multiple solder joints.

15. A crossed-dipole antenna array structure, as claimed in claim 7, wherein:

the dipole card defines a plurality of holes with each of the plurality of holes extending along one of the intersection lines and between one of the plurality of dipole card notches and the reflector line;

the crossing dipole card edge of each of the plurality of crossing dipole cards defines a tab that extends into one of the plurality of holes;

the notches, hole, and tab associated with each crossed-dipole antenna form a self-aligning structure for disposing the crossing dipole card substantially perpendicular to the dipole card.

16. A crossed-dipole antenna array structure, as claimed in claim 7, wherein:

each of the plurality of crossing dipole cards defines a hole extending along the intersection line;

the dipole card edge of the dipole card defines a plurality of tabs with each of the tabs extending into a hole defined by one of the plurality of crossing dipole cards;

the notches, hole, and tab associated with each crossed-dipole antenna form a self-aligning structure for disposing each of the crossing dipole cards substantially perpendicular to the dipole card.

17. A crossed-dipole antenna array structure, as claimed in claim 1, further comprising:

a heat sink that has a first planar heat sink surface;

wherein the planar heat sink surface is disposed substantially parallel to the first and second dipole card surfaces of the dipole card and is thermally connected to the dipole card;

wherein the heat sink is substantially entirely located on the antenna feed portion side of the reflector surface.

18. A crossed-dipole antenna array structure, as claimed in claim 17, wherein:

the heat sink includes a second planar heat sink surface that is substantially perpendicular to the first planar heat sink surface.

19. A crossed-dipole antenna array structure, as claimed in claim 18, wherein:

the second planar heat sink surface is thermally connected to the reflector.

20. A crossed-dipole antenna array structure, as claimed in claim 18, wherein:

the reflector includes a first reflector with a first reflector closed edge that defines the lateral extent of the first reflector and a second reflector with a second reflector closed edge that defines the lateral extent of the second reflector;

a portion of the dipole card is located between at least a portion of the first reflector closed edge and at least a portion of the second reflector closed edge;

the second planar heat sink surface is thermally connected to the first reflector to form a modular structure comprised of the dipole card with multiple crossing dipole cards, the heat sink and the first reflector.

21. A crossed-dipole antenna array structure, as claimed in claim 17, further comprising:

a power amplifier for each crossed-dipole antenna is located on the antenna feed portion of the dipole card and opposite to the first planar heat sink surface.

22. A crossed-dipole antenna array structure, as claimed in claim 1, wherein:

the reflector includes a first reflector with a first reflector closed edge that defines the lateral extent of the first reflector and a second reflector with a second reflector closed edge that defines the lateral extent of the second reflector.

23. A crossed-dipole antenna array structure, as claimed in claim 22, wherein:

a portion of the dipole card is located between at least a portion of the first reflector closed edge and at least a portion of the second reflector closed edge.

24. A crossed-dipole antenna array structure, as claimed in claim 1, wherein:

the multiple solder joints include two solder joints with each of the two solder joints located in a different one of the first, second, third, and fourth corners than the other of the two solder joints.

25. A crossed-dipole antenna array structure, as claimed in claim 24, wherein:

each of the two solder joints establishes an electrical connection between a conductor of a dual-line feed associated with a crossing dipole card and a transmission line associated with the dipole card.

26. A crossed-dipole antenna array structure, as claimed in claim 24, wherein:

the two solder joints are located in consecutive corners of the first, second, third, and fourth corners.

27. A crossed-dipole antenna array structure, as claimed in claim 24, wherein:

the two solder joints are located in non-consecutive corners of the first, second, third, and fourth corners.

28. A crossed-dipole antenna array structure, as claimed in claim 24, wherein:

at least one of the plurality of crossing dipole cards is located between two of the multiple dipole antennas associated with the dipole card.

29. A crossed-dipole antenna array structure comprising:

a dipole card having a first dipole card surface, a second dipole card surface that is separated from and substantially parallel to the first surface, and a dipole card edge that extends between the first dipole card surface and the second dipole card surface and defines the lateral extent of the dipole card;

wherein a reflector line that defines the position of a reflector surface disposed adjacent to the dipole card and extends between a first location on the dipole card edge and a second location on the dipole card edge;

wherein the dipole card includes an antenna portion that is located to one side of the reflector line and an antenna feed portion that is located to other side of the reflector line;

wherein multiple dipole antennas are associated with the dipole card, located in the antenna portion of the dipole card, and extend outward from the first dipole card surface and/or second dipole card surface;

a plurality of crossing dipole cards with each of the plurality of crossing dipole cards associated with one of the multiple dipole antennas of the dipole card;

wherein each of the plurality of crossing dipole cards has a first crossing dipole card surface, a second crossing dipole card surface that is separated from and substantially parallel to the first crossing dipole card surface, and a crossing dipole card edge that extends between the first crossing dipole card surface and the second crossing dipole card surface and defines the lateral extent of the crossing dipole card;

wherein each of the plurality of crossing dipole cards has at least a portion of a crossing dipole antenna that extends outward from the first crossing dipole card surface and/or second crossing dipole card surface;

wherein each of the crossing dipole cards extends substantially perpendicular to the dipole card;

wherein each of the at least a portion of a crossing dipole antenna associated with one of the crossing dipole cards is combined with one of the multiple dipole antennas associated with the dipole card to form a crossed-dipole antenna that is located on the same side of the reflector line as the antenna portion of the dipole card;

wherein the plurality of crossed-dipole antennas form an array of crossed-dipole antennas;

wherein each of crossing dipole cards and the dipole card define an intersection line and, when viewed from the same perspective and in a clockwise direction, consecutively define first, second, third, and fourth corners;

wherein a plurality of electrical connections are established between each of the crossing dipole cards and the dipole card by multiple solder joints with each solder joint located in one of the first, second, third, and fourth corners;

circuitry/electronics for processing an electrical signal to be provided to or received from each of the crossed-dipole antennas, the circuitry/electronics located in/on the antenna feed portion of the dipole card;

wherein the circuitry/electronics includes at least one power amplifier for each crossed-dipole antenna and the at least one amplifier is located on the antenna feed portion of the first dipole card surface of the dipole card and substantially adjacent to the reflector line;

a self-aligning structure for disposing each of the crossing dipole cards substantially perpendicular to the dipole card;

wherein the self-aligning structure includes one of: (a) a tab-and-hole structure in which a tab associated with one of the dipole card and a crossing dipole card engages a hole define by the other of the dipole card and the crossing dipole card, and (b) four rails that are substantially parallel to one another and each of the four rails is located substantially adjacent to one of the first, second, third, and fourth corners and in a different one of the first, second, third, and fourth corners than the other three rails;

a reflector with a reflector surface that extends along the reflector line;

the reflector includes a first reflector with a first reflector closed edge that defines the lateral extent of the first reflector and a second reflector with a second reflector closed edge that defines the lateral extent of the second reflector;

wherein the dipole card is located between a portion of the first reflector closed edge of the first reflector and a portion of the second reflector closed edge of the second reflector;

wherein the first and second reflectors have substantially the same shape;

a heat sink with a first heat sink surface that engages the second dipole card surface of the dipole card substantially adjacent to the reflector line and is positioned to receive heat generated by the at least one power amplifier associated with each of the crossed-dipole antennas and a second heat sink surface that thermally engages one of first and second reflectors; and a frame for supporting the dipole card, crossing dipole antenna cards, and the reflector.

* * * * *